US009370069B2

(12) United States Patent
Gong

(10) Patent No.: US 9,370,069 B2
(45) Date of Patent: Jun. 14, 2016

(54) MULTI-FUNCTION PIN FOR LIGHT EMITTING DIODE (LED) DRIVER

(71) Applicant: Infineon Technologies Austria AG, Villach (AT)

(72) Inventor: Xiaowu Gong, Singapore (SG)

(73) Assignee: Infineon Technologies Austria AG, Villach (AT)

( * ) Notice: Subject to any disclaimer, the term of this patent is extended or adjusted under 35 U.S.C. 154(b) by 428 days.

(21) Appl. No.: 13/969,963

(22) Filed: Aug. 19, 2013

(65) Prior Publication Data

US 2015/0048677 A1 Feb. 19, 2015

(51) Int. Cl.
*H05B 33/08* (2006.01)
*G09G 3/296* (2013.01)

(52) U.S. Cl.
CPC ..... *H05B 33/0851* (2013.01); *H05B 33/0854* (2013.01); *Y10T 307/352* (2015.04)

(58) Field of Classification Search
CPC ..... G09G 3/296
USPC ..... 307/51
See application file for complete search history.

(56) References Cited

U.S. PATENT DOCUMENTS 8,253,350 B2 8/2012 Hung et al.
8,716,949 B2 5/2014 Watanabe et al.
2010/0201283 A1 8/2010 Kawata et al.

FOREIGN PATENT DOCUMENTS

CN 201910952 U 7/2011
CN 102781139 A 11/2012

OTHER PUBLICATIONS

"SSL21081/SSL21083 Compact non-dimmable LED driver IC," NXP Semiconductors Product Data Sheet, Rev. 5 Oct. 11, 2012, 22 pp.

*Primary Examiner* — Robert Deberadinis
(74) *Attorney, Agent, or Firm* — Shumaker & Sieffert, P.A.

(57) ABSTRACT

Techniques are described for a multi-function pin of a light emitting diode (LED) driver. The techniques utilize this multi-function pin for switching current that flows through one or more LEDs, as well as for charging the power supply of the LED driver. The techniques further utilize this multi-function pin to determine whether the voltage at an external transistor is beginning to oscillate, and utilize this multi-function pin to determine whether the current through the one or more LEDs has fully dissipated to an amplitude of zero.

20 Claims, 10 Drawing Sheets

MULTI-FUNCTION PIN FOR LIGHT EMITTING DIODE (LED) DRIVER

TECHNICAL FIELD

The disclosure relates to light emitting diode (LED) drivers, and more particularly, to the internal and external circuitry of the LED drivers.

BACKGROUND

Light emitting diodes (LEDs) are connected to LED drivers. The LED drivers can control the illumination of the LEDs by controlling the amount of current that flows through the LEDs. In addition to controlling the current flowing through the LEDs, the LED drivers may be configured to implement other features such as diagnostic features (e.g., detecting voltages and currents) for various purposes. In some cases, implementing such diagnostic features requires additional pins on the LED drivers, which undesirably increases the circuit size or footprint of the LED drivers.

SUMMARY

In general, the techniques described in this disclosure are related to external and internal circuitry of a light emitting diode (LED) driver. For example, with the external and internal circuitry, as described in this disclosure, the LED driver may be able to both determine whether the voltage at connection points of a transistor connected to one or more LEDs is about to oscillate and determine whether the current flowing through the one or more LEDs dropped to zero through a single pin of the LED driver.

In some examples, the pin used to both determine whether the voltage at connection points of a transistor is about to oscillate and determine whether the current dropped to zero may provide additional functionalities. For example, the techniques may also charge the power supply of the LED driver, during startup and normal operation, through this same pin of the LED driver.

In one example, the disclosure describes a light emitting diode (LED) driver comprising an input pin that receives a current flowing through one or more LEDs into the LED driver, and a controller configured to determine whether a voltage at an external node that is external to the LED driver is beginning to oscillate based on a voltage at the input pin that receives the current in the LED driver, and determine whether the current flowing through the one or more LEDs has reached an amplitude of zero based on the voltage at the same input pin.

In one example, the disclosure describes a method comprising receiving, via an input pin of a lighting emitting diode (LED) driver, a current that flows through one or more LEDs into the LED driver, determining whether a voltage at an external node that is external to the LED driver is beginning to oscillate based on a voltage at the input pin, and determining whether the current flowing through the one or more LEDs has reached an amplitude of zero based on the voltage at the same input pin.

In one example, the disclosure describes a light emitting diode (LED) driver comprising an input pin that receives a current flowing through one or more LEDs into the LED driver, means for determining whether a voltage at an external node that is external to the LED driver is beginning to oscillate based on a voltage at the input pin, and means for determining whether the current flowing through the one or more LEDs has reached an amplitude of zero based on the voltage at the same input pin.

In one example, the disclosure describes a light emitting diode (LED) system comprising one or more LEDs, a transistor, wherein current flowing through the one or more LEDs flows through the transistor when the transistor is turned on and into an LED driver, and a capacitor connected to a drain node of the transistor and a source node of the transistor to couple changes in a voltage at the drain node of the transistor to the source node of the transistor for charging a power supply of the LED driver during normal operation mode, for determining whether the voltage at the drain node is beginning to oscillate, and for determining whether the current flowing through the one or more LEDs has reached an amplitude of zero.

In one example, the disclosure describes a light emitting diode (LED) driver system comprising one or more LEDs, and an LED driver that includes an input pin through which current flowing through the one or more LEDs enters the LED driver, wherein the LED driver is configured to utilize the input pin for determining whether voltage at a node external to the LED driver is beginning to oscillate, and configured to utilize the same input pin for determining whether the current flowing through the one or more LEDs has reached an amplitude of zero.

In one example, the disclosure describes a method comprising flowing current through one or more light emitting diodes (LEDs) through a transistor when the transistor is turned on and into an LED driver, and coupling, with a capacitor, changes in a voltage at a drain node of the transistor to a source node of the transistor for determining whether the voltage at the drain node is beginning to oscillate, and for determining whether the current flowing through the one or more LEDs has reached an amplitude of zero.

The details of one or more techniques of the disclosure are set forth in the accompanying drawings and the description below. Other features, objects, and advantages of the disclosure will be apparent from the description and drawings, and from the claims.

DETAILED DESCRIPTION

Figure 1:
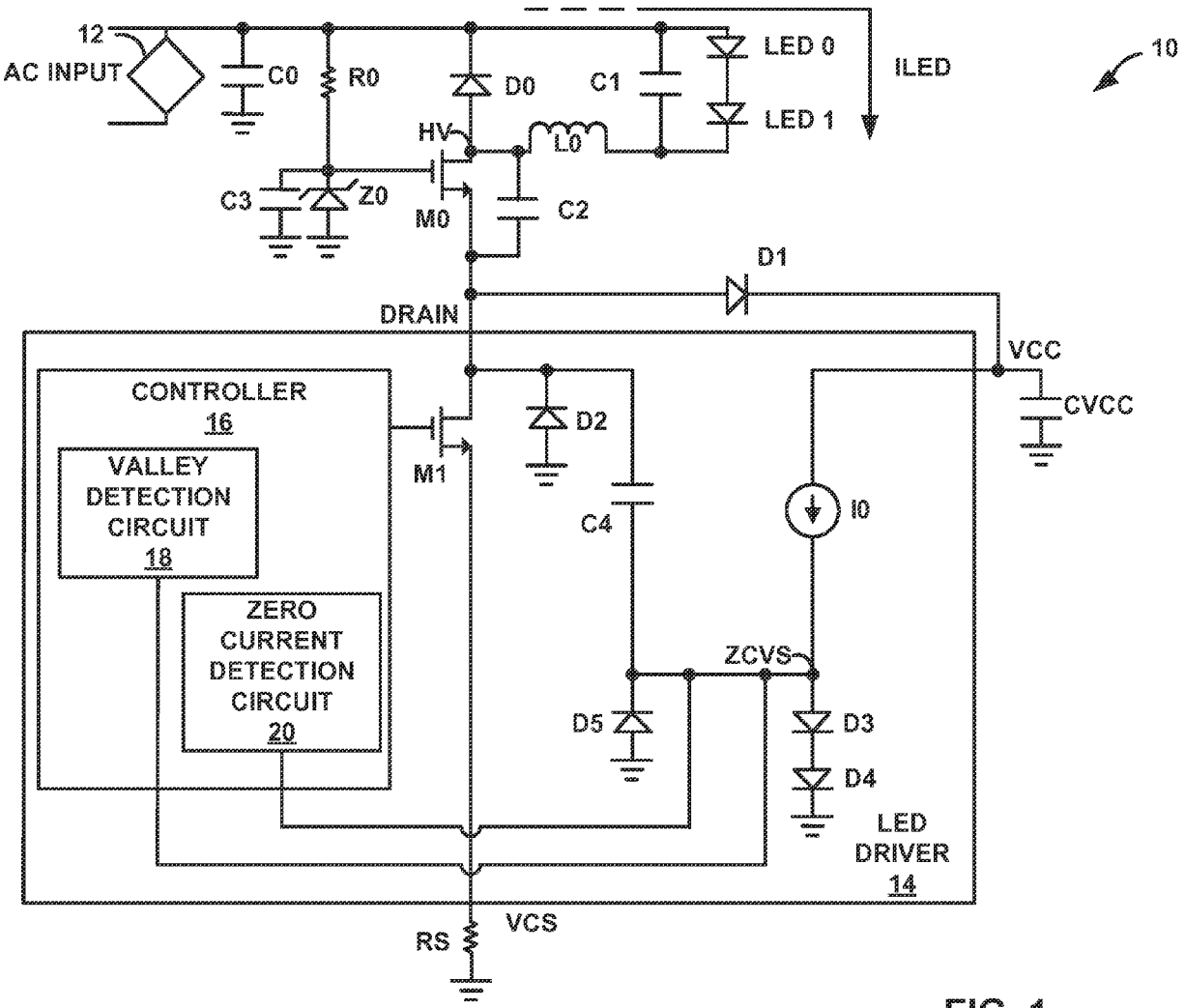
FIG. 1 is a circuit diagram illustrating an example of a light emitting diode (LED) driver system in accordance with one or more examples described in this disclosure.

Light emitting diodes (LEDs) illuminate when current flows through the LEDs. LED drivers control when the current flows through the LEDs and may control the amount of current that flows through the LEDs. The LED drivers utilize space or "real-estate" on the circuit board to which the LED drivers are attached. For example, the LED drivers may be formed as integrated-circuit (IC) chips. The IC chips include a plurality of pins for various types of electrical connections (e.g., power pin, ground pin, drain pin for where the current through the LEDs flows, and possibly other pins). Specific pins are sometimes used and possibly configured for specific diagnostic functions to be performed on the circuit. By reducing the number of pins on the LED drivers, the overall size of the LED drivers is reduced and potentially the cost of the LED drivers. A reduction in the size and/or cost of the LED drivers allows for additional space on the circuit board for other components, and/or allows for a smaller sized circuit board which reduces overall cost.

The techniques described in this disclosure allow for an LED driver to utilize one (i.e., single) pin to perform multiple functions that would otherwise require multiple pins. By reducing the size of the LED driver, a reduction in cost of the LED driver, as well as an increase in available space on the circuit board may be realized.

With a combination of circuitry external to the LED driver and circuitry internal to the LED driver, only a single pin may be needed to allow the LED driver to perform the following non-limiting example functions: power charging during startup and normal operation, LED current switching (i.e., turning LED current on and off), valley detection, and zero current detection. For instance, a single pin of the LED driver may be considered as an input pin, and the current that flows through the one or more LEDs flows through this input pin of the LED driver.

By controlling the circuitry connected to this input pin, the LED driver can control when and how much current flows through the one or more LEDs (i.e., control LED current switching). In addition, the circuitry external to the LED driver and circuitry internal to the LED driver may cause a voltage at this same input pin (i.e., the same pin from which the LED current flows into the LED driver), and the voltage at this input pin may cause the charging of the power pin (i.e., VCC pin) during startup and normal operation.

In some cases, when the LED driver causes the current through the one or more LEDs to turn off, it may be possible for the voltage at a node in the external circuitry to oscillate (e.g., ring). For example, the voltage at a drain node of an external transistor may oscillate when the LED driver causes the current through the one or more LEDs to turn off. When the LED driver causes the current through the one or more LEDs to turn off, the external transistor may be turned off.

The detection of this oscillation at the drain node of the external transistor is referred to as "valley detection" because the oscillation of the voltage causes the voltage at the node to drop then rise, or rise then drop, and then rise again, forming a "valley." The voltage oscillation may be in the form of alternating-current (AC) voltage since the voltage level is cycling up and down. If the external transistor is turned on at the valley point of the oscillation, the techniques may save switching power and the overall system may have higher efficiency.

As described in more detail, the external circuitry (i.e., circuitry external to the LED driver) and the internal circuitry (i.e., circuitry internal to the LED driver) may together allow the LED driver to determine when the oscillation is starting (i.e., perform valley detection). The LED driver may then take measures to turn the external transistor back on for savings in the switching power and for overall efficiency gains. As also described in more detail, in the techniques described in this disclosure, the external circuitry may couple the voltage of the node where the oscillation may be present to the same input pin (e.g., the same input pin for where the LED current flows into the LED driver and the same input pin that is used to charge the power pin), and the internal circuitry may deliver a substantially constant voltage at the input pin so that the voltage is not floating. With the coupling of the voltage of the oscillation and the substantially constant voltage, the LED driver may be able to detect the oscillation via the same input pin.

In some cases, it may be beneficial for the LED driver to detect the moment when the current through the LEDs falls to zero. For instance, even after the LED driver turns off the input current to the LEDs, the manner in which the LEDs are connected to the LED driver may cause the current to slowly dissipate through the LEDs (i.e., the current does not instantaneously turn off, but gradually turns off). In the techniques described in this disclosure, the LED driver may utilize the coupled voltage that the external circuitry couples and the substantially constant voltage that the internal circuitry delivers to determine whether the current through the LEDs has fallen to zero. For instance, the moment the current through the LEDs falls to zero may occur slightly before a full oscillation cycle of the voltage at the drain node of the external transistor in the external circuitry. By utilizing appropriate comparators (as one example), it may be possible for the LED driver to implement zero current detection and valley detection based on the voltage at the same input pin, which is also the input pin where the current flows into the LED driver and the input pin used to charge the power of the LED driver during startup and normal operation.

In this way, the external circuitry (circuitry external to the LED driver) couples voltage at a node external to the LED driver, where the voltage at the node potentially oscillates. The external circuitry couples the voltage at this node to the same input pin where the current through the LEDs flows into the LED driver. The internal circuitry (circuitry internal to the LED driver) stabilizes the voltage at the same input pin (i.e., delivers the substantially constant voltage), and additional internal circuitry utilizes the coupled voltage and the substantially constant voltage for valley detection and zero current level detection. The external circuitry that couples voltage to the input pin may also be utilized to charge supply power for the LED driver during startup and normal operation.

In this manner, this disclosure describes for a single pin solution for LED switching, power charging, valley detection, and zero current detection. Other techniques or circuits do not typically provide all such features, or may require additional pins for such features. With the techniques described in this disclosure, the LED driver is capable of providing robust functionality, while requiring minimal pins, which provides for a cheaper and smaller solution than other circuits.

FIG. 1 is a circuit diagram illustrating an example of a light emitting diode (LED) driver system in accordance with one or more examples described in this disclosure. For example, FIG. 1 illustrates LED driver system 10 which includes LED driver 14 and LED 0 and LED 1, where LED 0 and LED 1 are connected in series. Examples of LED driver system 10 include a circuit board with the illustrated components and LED driver 14, and plug for plugging into a power source, such as an AC input source. However, LED driver system 10 should not be considered limited to such examples.

Although LED driver system 10 is illustrated as including two LEDs (i.e., LED 0 and LED 1), the techniques described in this disclosure are not so limited. In some examples, LED driver system 10 may include one LED, and in some examples, LED driver system 10 may include more than two LEDs. In examples where LED driver system 10 includes two or more LEDs, the LEDs may be connected together in series, in parallel, or some combination of series and parallel connection. In general, LED driver system 10 includes one or more LEDs.

The one or more LEDs of LED driver system 10 illuminate when current flows through them. For example, FIG. 1 illustrates ILED flowing through LEDs 0 and 1. ILED originates from the AC input, which is an alternating-current (AC) voltage. Rectifier 12 rectifies the AC voltage, and capacitor C0 low-pass filters the rectified AC voltage to convert the AC voltage to a direct-current (DC) voltage. In some examples, the AC input may be connected to a limiting resistor (not shown) and/or an inductor (not shown) for protection purposes such as protection from short-circuits or fast changes in current.

Although LED driver system 10 is illustrated as being driven by an AC input, the techniques described in this disclosure are not so limited. In some examples, rather than an AC input, LED driver system 10 may be connected to a DC input. In these examples, LED driver system 10 may not include rectifier 12, and may not need to include capacitor C0. However, it may be possible for such a DC voltage driven system to include capacitor C0 to further smooth the DC voltage.

The DC voltage at capacitor C0 causes the ILED current to flow through LEDs 0 and 1, and through inductor L0. The ILED current then flows through external transistor M0. The external transistor M0 may be a power transistor, such as a power metal-oxide-semiconductor field-effect-transistor (MOSFET), a Gallium Nitride (GaN) FET, or other types of transistors, and is referred to as an external transistor because transistor M0 is external to LED driver 14. In FIG. 1, the ILED current enters transistor M0 through the drain node of transistor M0, which is labeled as HV. The ILED current flows out of the source node of transistor M0, and enters into LED driver 14.

As illustrated in the example of FIG. 1, LED driver 14 includes the DRAIN pin. The DRAIN pin is an input pin of LED driver 14 because the ILED current inputs into LED driver 14 via the DRAIN pin (i.e., LED driver 14 receives the ILED current via the DRAIN pin). This input pin of LED driver 14 is labeled as DRAIN because this input pin of LED driver 14 is connected to the drain node of internal transistor M1. Transistor M1 may also be a MOSFET, GaN FET, or other types of transistors, and is referred to as an internal transistor because transistor M1 is internal to LED driver 14. In some examples, transistor M1 may be a low voltage transistor, whereas transistor M0 may be a power transistor.

The ILED current flows out of the source node of transistor M1 through the resistor RS connected to the VCS pin of LED driver 14 and to ground, thereby forming a full current path. The value of the resistor RS may define the amplitude of the ILED current. In some examples, the resistor RS may be a variable resistor so that the amplitude of the ILED current can be modified dynamically (e.g., during operation).

In this way, transistor M0 and transistor M1 together form a switching circuit, with a cascade structure, that allows the ILED current to flow through LEDs 0 and 1. For example, if transistor M0 is off, then the ILED current will not flow through LEDs 0 and 1, and into LED driver 14, because transistor M0 will function as a high impedance unit that blocks the flow of current. Similarly, if transistor M1 is off, then the ILED current will not flow through LEDs 0 and 1, and into LED driver 14, because transistor M1 will function as a high impedance unit that blocks the flow of current.

In accordance with the techniques described in this disclosure, the DRAIN pin (referred to as an input pin) is a multi-function pin. The term "multi-function" means that LED driver 14 is configured to implement multiple different types of functions using this same input pin. In some examples, this input pin (i.e., the DRAIN pin illustrated in FIG. 1) may be referred to as a "single input multi-function pin." The phrase "single input multi-function pin" means that it may be possible to utilize only this input pin to implement the various different functions. Utilizing only this input pin to implement the various different functions means that circuitry external to LED driver 14 that is connected to LEDs 0 and 1 and not connected to LEDs 0 and 1 through LED driver 14 may need to be connected only to this "single input multi-function pin" (i.e., the DRAIN pin illustrated in FIG. 1) of LED driver 14.

For instance, capacitors C0, C2, and C3 indirectly connect to LEDs 0 and 1 through other circuit components which are all external to LED driver 14, and not through any circuit components within LED driver 14. The same is true for resistor R0, zener diode Z0, and transistor M0. Capacitor C1, diode D0, and inductor L0 directly connect to LEDs 0 and 1 (i.e., connect to LEDs 0 and 1 without any intermediate component). Resistor RS and capacitor CVCC are both external to LED driver 14, but do not connect (directly or indirectly) to LEDs 0 and 1 without connecting through LED driver 14. In this case, there is no external connection of resistor RS and capacitor CVCC to LEDs 0 and 1.

In other words, the phrase "single input multi-function pin" is used to mean that circuit components that are external to LED driver 14 and externally connect to LEDs 0 and 1 may need to only be connected to LED driver 14 via the single input multi-function pin. LED driver 14 need not include an additional pin that connects to the circuit components that externally connect to LEDs 0 and 1 for purposes of implementing the example functions described in this disclosure.

Stated yet another way, in some examples, only the voltage at the DRAIN pin or the current flowing through the DRAIN pin is needed to implement the various example functions described in this disclosure. However, it should be understood that for proper chip functioning, LED driver 14 may still require other pins for yet additional functions. For example, LED driver 14 requires power to operate, and hence, requires a power pin and a ground pin. LED driver 14 may also require other pins, such as the VCS pin, and other such pins for LED driver 14 to operate, and even if not required, such additional pins may be desirable. In the techniques described in this disclosure, such other pins, while desired or needed for LED driver 14 to operate in various ways, may not be necessary for implementing the various example functions described in greater detail in this disclosure.

In accordance with the techniques described this disclosure, LED driver 14 may implement ILED current switching, power charging during startup and normal operation, valley detection, and zero current detection utilizing the single input multi-function pin of LED driver 14. As illustrated, LED driver 14 includes controller 16. Controller 16 is illustrated as a general component that controls the gate node of transistor M1. For instance, controller 16 may cause transistor M1 to turn on by applying a voltage on the gate node of transistor M1 such that the voltage difference between the voltage at the gate of transistor M1 and the source node of transistor M1 is greater than or equal to a threshold turn-on voltage (Vth) (i.e., VGS>Vth). Controller 16 may cause transistor M1 to turn off by not applying a voltage on the gate node or applying a voltage that is less than the threshold turn-on voltage.

In some examples, controller 16 may be combination of different distinct components of LED driver 14, such as valley detection circuit 18 and zero current detection circuit 20 (as described in more detail). In some examples, the components of controller 16 may be formed together. In general, controller 16 is described functionally as one example component that controls when transistor M1 turns on and off. However, the components within controller 16 may individually or together control when transistor M1 turns on and off.

When controller 16 turns on transistor M1, the voltage at the drain node of transistor M1 drops. As illustrated in FIG. 1, the drain node of transistor M1 is the same as the DRAIN pin of LED driver 14 (i.e., the single input multi-function pin of LED driver 14). The drain node is connected to the source node of external transistor M0 (i.e., the source node of transistor M0 is also connected to the single input multi-function pin of LED driver 14). Accordingly, when the voltage at the drain node of transistor M1 drops, the voltage at the source node of transistor M0 also drops.

This drop in the voltage at the source node of transistor M0 causes transistor M0 to turn on. For example, the gate node of transistor M0 is connected to zener diode Z0. The breakdown voltage of zener diode Z0, at room temperature, may be approximately 12 volts (V), as one illustrative example. In this example, zener diode Z0 may limit the voltage at the gate node of transistor M0 to remain at approximately 12 V. With the drop in the voltage at the source node of transistor M0 (which is the same as the drain node of transistor M1), the difference in the voltage at the gate node of transistor M0 and the source node of transistor M0 is larger than the threshold turn-on voltage, and transistor M0 turns on.

Accordingly, when transistor M1 turns on, transistor M0 turns on. When both transistors M0 and M1 are on, the current ILED can flow through LEDs 0 and 1, thereby illuminating LEDs 0 and 1, through transistor M0 and into LED driver 14 via the single input multi-function pin (i.e., the DRAIN pin of LED driver 14). Once into LED driver 14, the ILED current flows through transistor M1 out of the VCS pin and through resistor RS to ground, which forms a complete circuit.

When controller 16 turns off transistor M1 (e.g., by not applying voltage at the gate node of transistor M1 or applying a voltage at the gate node of transistor M1 that is less than the sum of the voltage at the source node of transistor M1 and the threshold voltage), the voltage at the drain node of transistor M1 floats high. In this case (i.e., when transistor M1 is off), the voltage at the drain node of transistor M1 may float high enough that the voltage at the source node of transistor M0 rises to a point that transistor M0 turns off. For example, the drain node of transistor M1 and the source node of transistor M0 may be connected together at the DRAIN pin (i.e., at the single input multi-function pin). When the voltage of the drain node of transistor M1 rises, the voltage at the source node of transistor M0 may become large enough that the difference in the voltage at the gate node of transistor M0 and the source node of transistor M0 is less than the threshold turn-on voltage level.

In this case, the increase in the voltage at the source node of transistor M0 causes transistor M0 to turn-off. Accordingly, when transistor M1 is off, transistor M0 is also off. When transistors M1 and M0 are off, there is no current path to ground for ILED through LED driver 14.

It should be noted that when transistors M1 and M0 turn off, after being on, the ILED current does not immediately drop to zero. In FIG. 1, LEDs 0 and 1, inductor L0, capacitor C1, and diode D0 together form a floating buck topology (although other forms such as a tapped buck or quasi-flyback topology may be possible). It is generally well-understood that current through an inductor cannot change instantaneously. Therefore, when transistors M1 and M0 turn off, after being on, inductor L0 does not allow the ILED current to instantaneously drop to zero. Rather, the ILED current linearly drops to zero over some time, with the amount of time it takes the ILED current to drop to zero to be a function of the values of inductor L0 and capacitor C1. When transistor M1 and M0 are turned off and the ILED current is dissipating slowly to zero, the current path for the ILED current is a path through inductor L0 and diode D0 to form a complete current path.

As will be described below, the linear drop of the ILED current to zero may have an effect on the voltage oscillation at the drain node of transistor M0. The techniques described in this disclosure may utilize the occurrence of this oscillation to determine when to turn transistors M1 and M0 back on. As described in more detail, the techniques may utilize quasi_resonant techniques, in which the techniques turn transistors M1 and M0 back on when oscillation at the drain node of transistor M0 is detected (e.g., when the voltage at the drain node of transistor M0 is at a valley point). Also, the techniques described in this disclosure may utilize the occurrence of this oscillation to accurately determine whether the ILED current has reached zero.

In this way, LED driver 14 utilizes the singe input multi-function pin of LED driver 14 to switch current on and off through the one or more LEDs (i.e., LEDs 0 and 1) of LED driver system 10. For instance, because the drain node of transistor M1 and the source node of transistor M0 are connected to one another via the single input multi-function pin (i.e., DRAIN pin) of LED driver 14, by turning on and off transistor M1, LED driver 14 correspondingly turns on and off transistor M0. In accordance with the techniques described in this disclosure, by utilizing transistor M1 and M0 to switch the ILED current on and off, only a single connection to the external circuitry (i.e., circuitry external to LED driver 14) via the single input multi-function pin of LED driver 14 may be needed.

In addition to providing switching of the ILED current through the single input multi-function pin of LED driver 14, the techniques described in this disclosure may also charge the power for LED driver 14 through the single input multi-function pin of LED driver 14. The techniques described in this disclosure may charge the power for LED driver 14 via the current at the single input multi-function pin of LED driver 14 during startup and via the voltage at the single input multi-function pin of LED driver 14 during normal operation.

Startup refers to the time when LED driver system 10 receives power after being shut off. For example, when the circuit board that includes LED driver system 10 is connected to the AC input, LED driver system 10 may be considered to be in startup. If LED driver system 10 is removed from the AC input, and then subsequently reconnected to the AC input, LED driver system 10 starts-up again. The same startup would hold true if LED driver system 10 were being connected to a DC input, rather than an AC input. In general, the startup may be some pre-determined amount of time before the components of LED driver system 10 are in full operation. Prior to startup, the voltages and charges on the various components of LED driver system 10 may be zero.

During startup, there is an initial current that flows through resistor R0 and capacitor C3 and charges up capacitor C3. After some charge of capacitor C3, the voltage at the gate node of transistor M0 becomes large enough to turn on transistor M0. However, transistor M0 may not be fully turned on, but only partially turned on, to allow some current to flow through transistor M0.

With transistor M0 turned on, current flows through LEDs 0 and 1. However, because transistor M0 is only partially turned on, the amplitude of the current that flows through LEDs 0 and 1, during startup, may be less than the amplitude of the ILED current. To avoid confusion between the current during startup, and the ILED current, the current during startup, is referred to as the startup current.

The startup current flows out of the source of transistor M0 and into the single input multi-function pin (i.e., the DRAIN pin) of LED driver 14. The startup current flows through diode D1 and charges the CVCC capacitor. The CVCC capacitor may be considered to be a type of power supply for LED driver 14. For example, once the CVCC capacitor is charged up, the CVCC capacitor delivers the voltage and discharges to deliver the current needed to power the components of LED driver 14.

As one example, during startup, resistor R0 will charge capacitor C3, when the voltage on capacitor C3 is approximately 4.2V, transistor M0 may be turn on and charge the CVCC capacitor. The threshold voltage for transistor M0 may be approximately 3.5V and the voltage drop across diode D1 may be approximately 0.7V, which results in capacitor C3 being charged to 4.2V before the CVCC capacitor begins charging, in this non-limiting example. In this example, during startup, the current path is through LEDs 0 and 1, through transistor M0, through diode D1, and into the CVCC capacitor for charging the CVCC. Once the voltage across the CVCC capacitor reaches a threshold voltage (e.g., approximately 12V), the CVCC capacitor is able to supply voltage and current to the components of LED driver 14.

In this way, during startup, the techniques utilize the single input multi-function pin (i.e., the DRAIN pin) for charging the power supply (e.g., CVCC) of LED driver 14. Again, the single input multi-function pin is also the same pin through which the ILED current flows. Accordingly, during startup, the startup current that flows through the single input multi-function pin charges the power supply of LED driver 14.

Figure 2A:
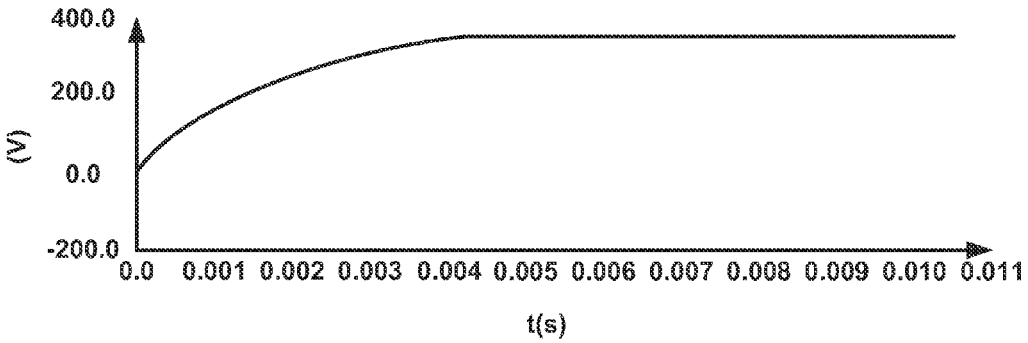
FIGS. 2A-2C are waveforms that illustrate the voltages of various nodes of an LED driver system such as voltage at input of a rectifier, voltage at a gate node of an external transistor, and voltage at a capacitor, respectively, during startup.
Figure 2B:
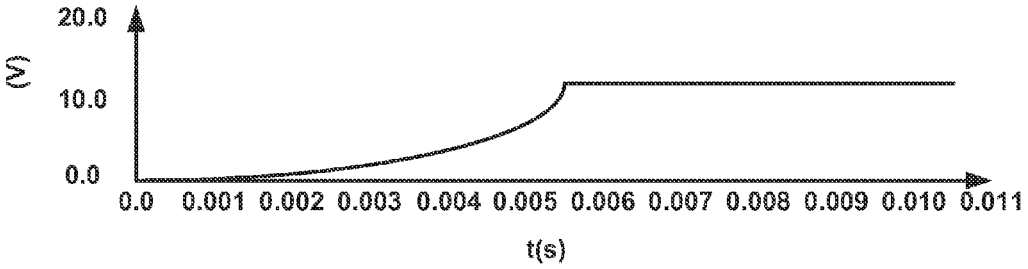
Figure 2C:
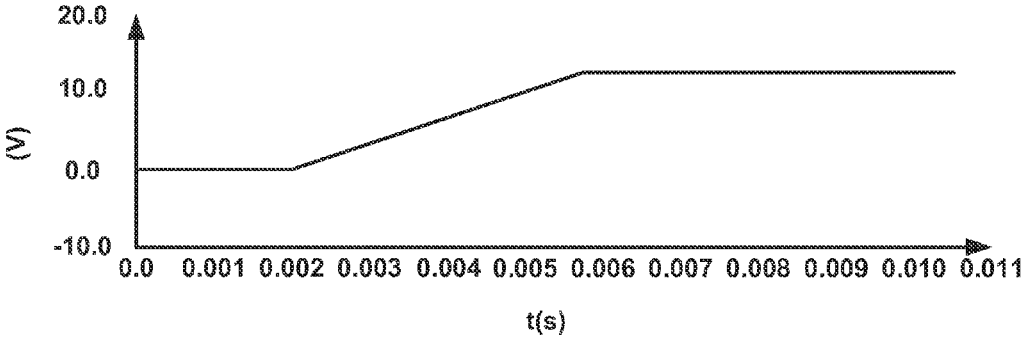

FIGS. 2A-2C are waveforms that illustrate the voltages of various nodes of an LED driver system during startup. FIG. 2A illustrates the voltage at the input of rectifier 12. FIG. 2B illustrates the voltage at the gate node of external transistor M0. FIG. 2C illustrates the voltage across CVCC (e.g., the voltage at the VCC pin of LED driver 14).

As illustrated in FIG. 2A, the voltage at the input of rectifier 12 is initially at zero. Then, when LED driver system 10 is connect to the AC input, the voltage at the input of rectifier 12 rises up to approximately 300 VAC. In this example, approximately a quarter of the full AC voltage cycle is illustrated in FIG. 2A.

As illustrated in FIG. 2B, as the voltage at the input of rectifier 12 increases, the voltage at the gate node of transistor M0 rises. For example, capacitor C0 provides a smooth DC voltage, and capacitor C3 charges from zero volts up to approximately 12V through resistor R0. As described above, the breakdown voltage of zener diode Z0 is approximately 12V in this example, which causes the voltage across capacitor C3 to charge up to, and not beyond, 12V. Since capacitor C3 is connected to the gate node of transistor M0, the voltage across capacitor C3 is the same as the voltage at the gate node of M0.

As the voltage at the gate node of transistor M0 (e.g., at capacitor C3) rises, transistor M0 starts turning on. For instance, transistor M0 is not fully, but partially turned on. Transistor M0 being partially turned on allows for a startup current to flow through LEDs 0 and 1 through inductor L0 and transistor M0.

This startup current then flows through diode D1 and places charge on capacitor CVCC (i.e., charges up the power supply of LED driver 14). For instance, as illustrated in FIG. 2C, the voltage at the VCC pin of LED driver 14 initially starts at zero volts, and then starts to rise until the voltage at the VCC pin reaches to a voltage greater than (7V) in this example. In this example, the startup current flows through the same single input multi-function pin that the ILED current flows through. Therefore, additional pins are not needed for power supply charging and for ILED current switching, and the same pin of LED driver 14 can be used for both purposes.

After startup, LED driver 14 is configured in normal operation mode. In normal operation mode, the CVCC capacitor is fully charged by the startup current and is delivering power to the various components of LED driver 14. However, the delivery of power depletes the charge across the CVCC capacitor and the CVCC capacitor may be required to be periodically recharged so that the CVCC capacitor can provide power during normal operation.

In the techniques described in this disclosure, the CVCC capacitor may be powered during normal operation via the same single input multi-function pin that the techniques use for ILED current switching and for charging the CVCC capacitor during startup. However, in this case, rather than relying on the startup current flowing through the single input multi-function pin of LED driver 14 (i.e., the DRAIN pin), the techniques rely on voltage that is AC coupled to the single input multi-function pin of LED driver 14 for power charging during normal operation.

Referring back to FIG. 1, during normal operation, controller 16 may cause the ILED current to turn on or off, as desired. For instance, there may be certain times when it is desirable for LEDs 0 and 1 to be turned off, and certain times when it is desirable for LEDs 0 and 1 to be turned on. Turning LEDs 0 and 1 on and off means switching the ILED current on and off. The switching of the ILED current on and off affects various voltage nodes on the external circuitry, such as the drain node of transistor M0, labeled as the HV node.

For instance, as described above, when the ILED current is on, the transistor M1 is turned on, and the voltage at the drain node of transistor M1, which is also the source node of transistor M0, is low. Also, when the ILED current is on, the voltage at the drain node of transistor M0 (i.e., the HV node) is also low. When the ILED current is off, the transistor M1 is turned off, and the voltage at the drain node of transistor M1, which is also the source node of transistor M0, is high. When the ILED current is off, the voltage at the drain node of transistor M0 (i.e., the HV node) is also high.

Accordingly, during normal operation, the voltage at the HV node rises and falls due to the switching on and off of the ILED current. The techniques described in this disclosure exploit the rising and the falling of the voltage at the HV node to charge the CVCC capacitor.

For example, as illustrated in FIG. 1, the drain node of transistor M0 and the source node of transistor M0 are connected to one another via capacitor C2. In accordance with the techniques described in this disclosure, when controller 16 switches off the ILED current (i.e., by turning off transistor M1), the voltage at the drain node of transistor M0 (i.e., HV node) rises. Capacitor C2 AC couples the voltage change at the drain node of transistor M0 to the source node of transistor M0.

AC coupling, as used in this disclosure, refers to synchronized changes in the voltages across a capacitor, such as capacitor C2. This disclosure may use the term "coupling" as a substitute for "AC coupling" for purposes of brevity. Such coupling is because a voltage across a capacitor cannot change instantaneously. For example, if the voltage at the HV node changes quickly, capacitor C2 causes the voltage at the DRAIN pin of LED driver 14 to change quickly so that the voltage across capacitor C2 remains the same. For instance, if the voltage at the HV node rises quickly, capacitor C2 causes the voltage at the DRAIN pin of LED driver 14 to rise quickly as well so that the voltage across capacitor C2 is the same. If the voltage at the HV node drops quickly, capacitor C2 causes the voltage at the DRAIN pin of LED driver 14 to drop quickly as well so that the voltage across capacitor C2 is the same.

However, if the voltage at the HV node reaches a steady DC voltage level (e.g., not rising quickly or falling quickly), then capacitor C2 functions as a high impedance unit (e.g., capacitor C2 functions as a high pass filter that filters out the DC voltage level). In other words, for AC voltage, where there are sudden, quick changes in the voltage level, capacitor C2 functions as a low impedance unit, and there is little to no drop across capacitor C2. For DC voltage, where there are no sudden, quick changes in the voltage level, capacitor C2 functions as a high impedance unit. In this manner, capacitor C2 AC couples the voltage from the drain node of transistor M0 to the DRAIN pin of LED driver 14, which is also the drain node of transistor M1.

As illustrated, the source node of transistor M0 is connected to the same single input multi-function pin of LED driver 14. The voltage coupled (i.e., AC coupled) from the HV node to the single input multi-function pin of LED driver 14 via capacitor C2 charges capacitor CVCC. For example, after startup and during normal operation, the charge on capacitor CVCC dissipates as capacitor CVCC supplies power to the components of LED driver 14. However, because the voltage at the HV node rises and falls during normal operation based on when the ILED current is flowing, capacitor C2 couples (i.e., AC couples) the voltage from the HV node to the single input multi-function pin, which in turn recharges capacitor CVCC so that capacitor CVCC can keep supplying power to the components of LED driver 14.

In this manner, the techniques provide for two different ways in which to charge the power supply of LED driver 14: a first way during startup and a second way during normal operation. In both startup and normal operation, the techniques utilize the same pin of LED driver 14, and only that pin of LED driver 14 (i.e., only the DRAIN pin of LED driver 14) for power supply charging (i.e., the same pin of LED driver 14 and no other pin of LED driver 14). For instance, during startup, the current flowing through the DRAIN pin of LED driver 14 charges capacitor CVCC, and during normal operation, the coupling of the voltage at the drain node of transistor M0 through the DRAIN pin of LED driver 14 charges capacitor CVCC. In these examples, no other pins of LED driver 14 are needed for purposes of such power charging during both startup and normal operation of LED driver 14.

Utilizing these two different ways to charge the power supply of LED driver 14 allows LED driver 14 to self-supply its voltage. For example, the LED driver 14 chip does not need to be connected to an external power source. Rather, the current and the voltage at the single input multi-function pin (i.e., DRAIN pin) of LED driver 14 are sufficient to charge the power supply of LED driver 14.

As illustrated, the VCC pin of LED driver 14 is connected to the CVCC capacitor and to diode D1. Although diode D1 is illustrated as being external to LED driver 14, in some examples, diode D1 may be internal to LED driver 14. Diode D1 provides a level of protection for the voltage at the DRAIN pin. For example, at the room temperature, the voltage drop across diode D1 is 0.7V. Diode D1 clamps the voltage at the DRAIN pin so that the voltage at the DRAIN pin cannot be greater than VCC+0.7V, where VCC is the voltage across the CVCC capacitor and 0.7V is the voltage diode drop of diode D1. In some examples, the VCC voltage may be approximately 12V, as illustrated in FIG. 2C.

Diode D2 may also provide protection for the voltage at the DRAIN pin. For instance, diode D2 may clamp the voltage at the DRAIN pin so that the voltage cannot be less than −0.7V. In this manner, diode D1 clamps the voltage at the DRAIN pin so that the voltage cannot be greater than VCC+0.7V, and diode D2 clamps the voltage that the DRAIN pin so that the voltage cannot be less than −0.7V.

In some examples, although not shown in FIG. 1, the VCC pin of LED driver 14 may be connected to additional diodes. These diodes may clamp the voltage of VCC so that the voltage of at the VCC pin cannot rise to high. For example, if the voltage at the HV node (i.e., drain of transistor M0) rises quickly and to a high level, then it may be possible for the voltage at the VCC pin (i.e., across capacitor CVCC) to rise quickly and to a high level. However, it may not be desirable for the voltage at the VCC pin to rise to such a level, and additional clamping diodes within LED driver 14 or external to LED driver 14 and connected to the VCC pin may ensure that the voltage at the VCC pin (e.g., the power supply voltage) does not rise too high. In some examples, the diodes may claim the voltage of VCC to 18V (i.e., the VCC voltage cannot be greater than 18V).

In addition to allowing the ILED current switching and the charging of the power supply of LED driver 14 during startup and normal operation via the same single input multi-function pin, the techniques described in this disclosure may also utilize the same single input multi-function pin of LED driver 14 for valley detection and zero current level detection. As described in more detail below, valley detection circuit 18 and zero current detection circuit 20 may be configured for valley detection and zero current level detection respectively.

Valley detection refers to detecting the occurrence of oscillations on the drain node of transistor M0. In some examples, as described in more detail, valley detection circuit 18 may be configured to implement quasi_resonant techniques. For example, when the voltage at the drain node of transistor M0 reaches a valley point (possibly due to the oscillations), valley detection circuit 18 may cause transistors M0 and M1 to turn back on, which may be advantageous in terms of power savings and efficiency.

While the ILED current flows through LEDs 0 and 1, the voltage at the drain node of transistor M0 is fairly stable. For example, while transistors M0 and M1 are both turned on, the ILED current flows through transistors M0 and M1. After being on, when transistors M0 and M1 are both turned off, the ILED current does not immediately drop to zero. Instead, the ILED current linearly drops to zero due to inductor L0 and capacitor C1 (i.e., the floating buck topology).

During the time when the ILED current is flowing through transistors M0 and M1 and during the time when the ILED current is dissipating through inductor L0 and capacitor C1, the voltage at the drain node of transistor M0 is steady (e.g., a DC voltage that is not fluctuating). However, shortly after the ILED current reaches the zero level, the voltage at the drain node of transistor M0 begins to oscillate (e.g., ring). For instance, the voltage at the drain node of transistor M0 begins to rise and fall in a rippling fashion. The voltage at the drain node falling and then rising can be viewed as creating a valley. The techniques described in this disclosure detect the occurrence of such a valley (i.e., valley detection) based on the voltage at the same single input multi-function pin (i.e., the DRAIN pin).

The reason for the voltage oscillation, at the drain node of transistor M0 may be due to transistor M0 being a power transistor (e.g., a power MOSFET), and a characteristic of a power MOSFET being connected to an inductor (e.g., inductor L0) is that the voltage at the drain node oscillates when the current dissipates. If transistor M0 is turned back on at the time the voltage drain node begins to oscillate (e.g., implement quasi_resonant techniques), there may be reduction in switching power and an overall increase in efficiency as compared to if transistor M0 is turned back on during the oscillation. In other words, reduction in switching power and efficiency gains may be realized if transistor M0 is turned back on at the occurrence of a first valley point in the oscillation. Accordingly, it may be beneficial to detect the occurrence of the oscillation at the drain node of transistor M0 so as to determine when transistor M0 should be turned back on.

Figure 3A:
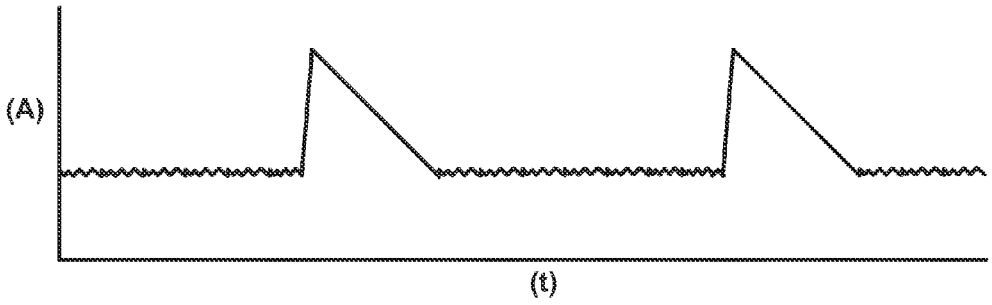
FIG. 3A is a waveform that illustrates the amplitude of the current flowing through the one or more LEDs of the LED driver system.
Figure 3B:
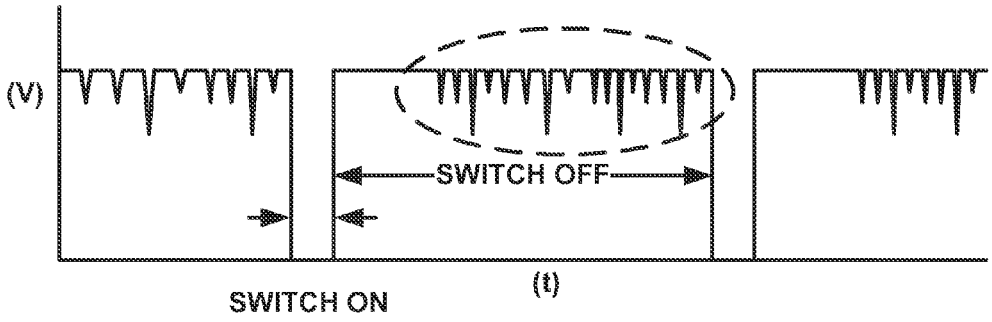
FIGS. 3B and 3C are waveforms that illustrate the voltage at various nodes of the LED driver system such as a drain node of an external transistor and a drain node of an internal transistor, respectively.
Figure 3C:
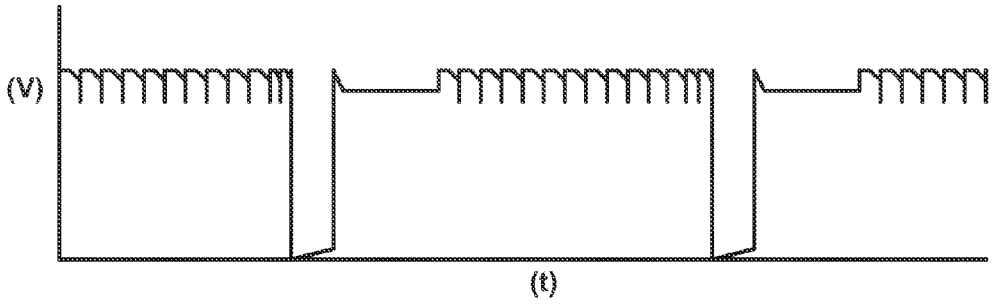

FIG. 3A is a waveform that illustrates the amplitude of the current flowing through the one or more LEDs of the LED driver system. FIGS. 3B and 3C are waveforms that illustrate the voltage at various nodes of the LED driver system. In particular, FIGS. 3A-3C are conceptual waveforms to illustrate the occurrence of voltage oscillation at the HV node.

For example, FIG. 3A illustrates the flow of the ILED current through LEDs 0 and 1. During the switch on time, as illustrated in FIG. 3B, transistors M0 and M1 are turned on, and the amplitude of the ILED current rises quickly as the ILED current flows through the transistor M0 and M1. At the switch off time, also illustrated in FIG. 3B, the ILED current does not turn off immediately. Rather, as illustrated in FIG. 3A, the ILED current linearly dissipates down to an amplitude of zero amperes (A). As described above, the reason for this linear dissipation of the ILED current, rather than instantaneous drop in the ILED current, is due to the floating buck topology that includes inductor L0 and capacitor C1. In this disclosure, the amount of time from when transistor M0 and M1 turn off to the time when ILED current becomes zero is referred to as a current dissipation duration.

FIG. 3B illustrates the voltage at the drain node of the external transistor M0. During the switch on time (i.e., when transistors M0 and M1 are turned on), the voltage at the drain node of the external transistor M0 (i.e., the HV node) is approximately zero volts. When transistor M0 and M1 are turned off at the switch off time, the voltage at the drain node of the external transistor M0 is steady during the current dissipation duration. For example, as the current is dissipating through the floating buck topology, the voltage at the HV node is at a steady DC voltage. Then, shortly after the current dissipation duration (i.e., shortly after the ILED current reaches zero), the voltage at the HV node oscillates, as illustrated by the dashed oval in FIG. 3B.

As illustrated, shortly after the amplitude of the ILED current reaches zero amps, the voltage at the HV node quickly drops, then rises, then drops, then rises, and so forth until the next switch on time. The amount that the voltage drops per drop and rise cycle may vary. This dropping and rising of the voltage at the HV node creates voltage "valleys," and a valley may be identified by a valley point, which is the lowest voltage for that valley. For example, the initial drop of the voltage at the HV node, followed by the rise creates a local minima voltage at the HV node (e.g., a first voltage valley point). After the rise, there is another drop of the voltage at the HV node, followed by another rise, which creates another local minima voltage at the HV node (e.g., a second voltage valley point). The voltage level of each local minima voltage may be different.

In some examples, the amount of power needed to turn transistor M0 back on at a voltage valley point is less than the amount of power needed to turn transistor M0 back on at a peak point. Accordingly, power savings may be realized by turning transistor M0 back on at the occurrence of a first voltage valley point, rather than turning transistor M0 back on at a peak point or intermediate point (e.g., between valley and peak points). The power savings achieved by turning transistor M0 back on at a valley point, rather than at a peak point or an intermediate point, may result in better switching efficiency.

In some examples, the techniques described in this disclosure may detect the occurrence of the oscillations (e.g., via valley detection) utilizing the voltage input that the single input multi-function pin (DRAIN pin) of LED driver 14, without utilizing any other input pins of LED driver 14. In other words, LED driver 14 may not need any connection to the external circuitry that connects to LEDs 0 and 1 in addition to the connection at the DRAIN pin to implement valley detection.

FIG. 3C illustrates the voltage at the single input multi-function pin (DRAIN pin) of LED driver 14. As illustrated, the voltage at the DRAIN pin of LED driver 14 exhibits similar characteristics as those of the voltage at the HV node. For instance, during the switch on time, the voltage at the DRAIN pin of LED driver 14 is approximately zero volts. After the switch off time, and during the current dissipation duration, the voltage at the DRAIN pin of LED driver 14 is steady (e.g., at a DC voltage). However, shortly after the ILED current reaches zero (i.e., shortly after the current dissipation duration), the voltage at the DRAIN pin of LED driver 14 also beings to oscillate similar to the voltage at the HV node (the drain node of external transistor M0).

The reason that the voltage at the DRAIN pin begins to oscillate similar to the voltage at the drain node of external transistor M0 is due to the AC coupling of the voltage from the drain node of external transistor M0 to the DRAIN pin of LED driver 14. For instance, the oscillation at the drain node of external transistor appears as AC voltage due to the falling and rising of the voltage, and the techniques described in this disclosure may couple the AC voltage to the DRAIN pin of LED driver 14.

For example, as illustrated in FIG. 1, the external circuitry includes capacitor C2. As described above, one of the functions of capacitor C2 is to couple (i.e., AC couple) the voltage at the drain node of external transistor M0 to the DRAIN pin of LED driver 14 to recharge capacitor CVCC during normal operation so that capacitor CVCC can provide power to LED driver 14. In the techniques described in this disclosure, another function of capacitor C2 is to AC couple the voltage at the drain node of external transistor M0 to the DRAIN pin of LED driver 14 so that LED driver 14 may detect the occurrence of a valley at the drain node of external transistor M0.

As described above, AC coupling of the voltage, as used in this disclosure, may mean coupling where AC voltage pass, but DC voltage is unable to pass. For example, the voltage across capacitor C2 may not change instantaneously, which is a basic property of capacitors. Therefore, when the voltage at the drain node of transistor M0 drops quickly due to the AC voltage oscillation, the voltage at the DRAIN pin of LED driver 14 also drops quickly so that the voltage across capacitor C2 remains the same. Similarly, when the voltage at the drain node of transistor M0 rises quickly due to the AC voltage oscillation, the voltage at the DRAIN pin of LED driver 14 also rises quickly so that the voltage across capacitor C2 remains the same. However, capacitor C2 does not allow DC voltage to pass through.

In accordance with the techniques described in this disclosure, LED driver 14 may utilize the coupled voltage at the single input multi-function pin (i.e., DRAIN pin) of LED driver 14 for valley detection. For example, as illustrated in FIG. 1, the DRAIN pin of LED driver 14 is connected to capacitor C4, where capacitor C4 is internal to LED driver 14. Capacitor C4 couples the voltage at the DRAIN pin of LED driver 14 to the node labeled ZCVS in FIG. 1. For instance, similar to capacitor C2, capacitor C4 provides a low impedance path for AC voltages, and a high impedance path for DC voltages (e.g., functions as a high pass filter).

Therefore, in accordance with the techniques described in this disclosure, when there is a sudden change in the voltage at the drain node of transistor M0, capacitor C2 couples the sudden change in the voltage to the single input multi-function pin (DRAIN pin) of LED driver 14. Capacitor C4 then couples the sudden change in the voltage to the ZCVS node within LED driver 14. Accordingly, as soon as there is an oscillation, such as a sudden drop, in the voltage at the drain node of transistor M0 (the HV node), the sudden drop in the voltage is coupled to the ZCVS node internal to LED driver 14 via external capacitor C2 and internal capacitor C4.

In accordance with the techniques described in this disclosure, valley detection circuit 18 of controller 16 may utilize the voltage level at the ZCVS node to determine whether oscillations at the drain node of transistor M0 are occurring. However, for valley detection circuit 18 to determine whether oscillations at the drain node of transistor M0 are occurring, the voltage at the ZCVS node may need to be stabilized.

One effect of the coupling is that voltage at the ZCVS node may be floating without the current source I0. Current source I0 is described in more detail. For example, the voltage at the ZCVS node, by itself, would not be referenced to any voltage within LED driver 14. In other words, the voltage at the ZCVS node, within LED driver 14, would rise and fall due to the coupling, but the voltage relative to which the AC voltage is rising and falling may be indeterminate. As an illustration, assume for ease of understanding only, that the voltage at the ZCVS node rises 0.1V and drops 0.1V. However, in this case, it may be unknown from what voltage level the ZCVS node rises 0.1V and from what voltage level the ZCVS node drops 0.1V.

Without some reference voltage relative to which the voltage at the ZCVS node rises and falls, valley detection circuit 18 may not be able to determine whether the voltage at the ZCVS node is rising or falling. For example, without some circuitry that delivers a substantially constant voltage relative to which the voltage at the ZCVS nodes rises or falls, the voltage at the ZCVS node is not referenced to same voltage as valley detection circuit 18.

In accordance with the techniques described in this disclosure, LED driver 14 may include internal circuitry that delivers a substantially constant voltage (e.g., a DC voltage) across which the voltage at the ZCVS node can swing (i.e., rise and fall). For example, FIG. 1 illustrates current source I0 and diodes D3-D5, which are all internal to LED driver 14. Current source I0 and diodes D3-D5 are example components of internal circuitry that delivers a substantially constant voltage across which the voltage at the ZCVS node can swing. Other techniques to deliver such a substantially constant voltage (e.g., DC voltage) may also be possible, and the techniques described in this disclosure are not limited to using current source I0 and diodes D3-D5 to deliver the substantially constant voltage across which the voltage at the ZCVS node can swing.

Current source I0 may be an independent current source that outputs a fixed amount of current. As illustrated, current source I0 is connected to the VCC pin of LED driver 14, which means that the current outputted by current source I0 is referenced to the same voltage as the voltage that supplies power to the rest of LED driver 14 including valley detection circuit 18. At normal temperatures, diodes D3 and D4 each provide a 0.7V change (each) in the voltage level for a total of 1.4V across D3 and D4. Therefore, the current flowing from current source I0 in combination with the voltage across diodes D3 and D4 delivers a substantially constant voltage of approximately 1.4V at the ZCVS node, and the coupled voltage at the ZCVS node rise and fall relative to the 1.4 DC volts at the ZCVS node.

Diode D5 may provide additional safety to avoid the substantially constant (e.g., DC) voltage at the ZCVS node from falling below −0.7V for normal temperatures. Diode D5 may not be necessary in every example. Furthermore, if a voltage level greater than 1.4V is desired at the ZCVS node, additional diodes may be connected in series with diodes D3 and D4. Also, if a voltage level lower than 1.4V is desired at the ZCVS node, fewer diodes may be connected (e.g., only one diode, rather than both diodes D3 and D4).

With the ZCVS node properly referenced with internal circuitry that delivers a substantially constant voltage (i.e., current source I0 and diodes D3 and D4), valley detection circuit 18 may determine whether there are any changes in the voltage at the ZCVS node relative to the DC voltage at the ZCVS node. If valley detection circuit 18 determines that there are changes in the voltage at the ZCVS node and the change is of sufficient magnitude, valley detection circuit 18 may determine that the voltage at the drain node of transistor M0 is beginning to oscillate.

In some examples, if valley detection circuit 18 determines that the voltage at the drain node of transistor M0 is beginning to oscillate, in response, valley detection circuit 18 may cause controller 16 to turn transistor M1 back on. To reiterate, the voltage oscillation at the HV node (drain node of transistor M0) occurs when transistor M0 and M1 are turned off, and shortly after the ILED current has fully dissipated. By turning transistor M1 back on, transistor M0 turns back on, and the ILED current can flow through transistor M0 and M1. When the ILED current flows through transistors M0 and M1, there may not be any voltage oscillation. In this way, valley detection circuit 18 may determine (e.g., detect) when a valley point occurs in the voltage at the drain node of transistor M0 and squelch the oscillation. In some examples, in case valley detection circuit 18 does not detect a valley point, controller 16 may turn transistors M1 and M0 back on after 30 us of being off.

Figure 4A:
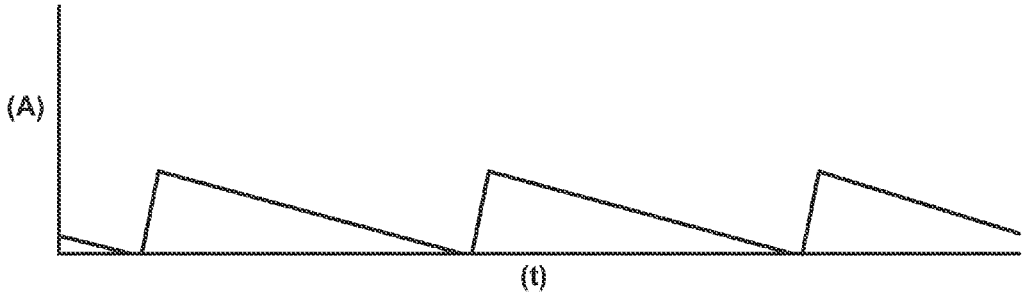
FIG. 4A is a waveform that illustrates the amplitude of the current flowing through the one or more LEDs of the LED driver system when valley detection is enabled.
Figure 4B:
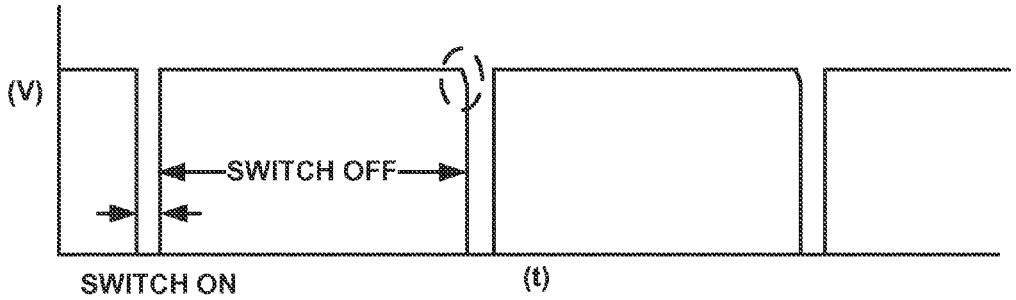
FIGS. 4B and 4C are waveforms that illustrate the voltage at various nodes of the LED driver system such as a drain node of an external transistor and a drain node of an internal transistor, respectively, when valley detection is enabled.
Figure 4C:
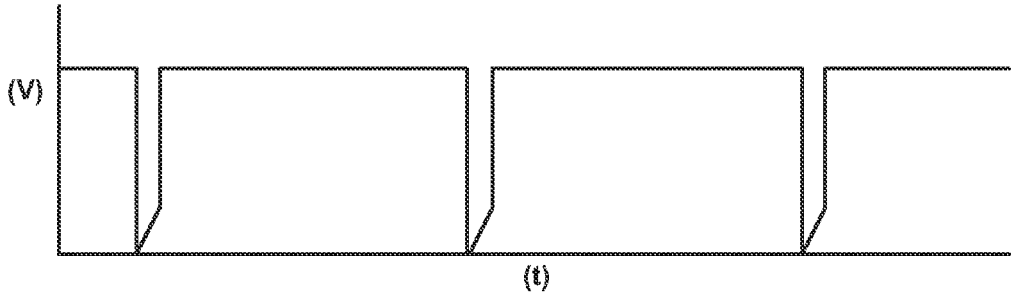

FIG. 4A is a waveform that illustrates the amplitude of the current flowing through the one or more LEDs of the LED driver system when valley detection is enabled. FIGS. 4B and 4C are waveforms that illustrate the voltage at various nodes of the LED driver system when valley detection is enabled. In particular, FIGS. 4A-4C are conceptual waveforms to illustrate that there may not be any voltage oscillation at the HV node when valley detection is enabled.

For example, similar to FIG. 3A, FIG. 4A illustrates the flow of the ILED current through LEDs 0 and 1. For instance, similar to FIG. 3A, FIG. 4A illustrates that during the switch on time when transistors M0 and M1 are turned on, the ILED current rises quickly and flows through transistors M0 and M1. Then, at the switch off time when transistors M0 and M1 are turned off, the ILED current slowly and linearly dissipates over time until the ILED current reaches an amplitude of zero.

However, unlike FIG. 3A, in FIG. 4A, shortly after the ILED current reaches an amplitude of zero, the ILED current rises back quickly. This is because valley detection circuit 18 determines that the voltage at the HV node is beginning to oscillate, and in response turns on transistor M1, which causes transistor M0 to turn on. This results in the ILED current flowing through transistors M0 and M1 again.

For example, FIG. 4B illustrates the voltage at the HV node. In this case, shortly after the switch off time, the voltage at the HV node drops. This is an indication that the voltage at the HV node is beginning to oscillate. In FIG. 4B, the dashed oval illustrates the sudden voltage drop at the HV node shortly after the current dissipation duration.

In accordance with the techniques described in this disclosure, capacitor C2 couples the sudden voltage drop at the HV node to the DRAIN pin of LED driver 14. Capacitor C4 couples the sudden voltage drop at the DRAIN pin of LED driver 14 to the ZCVS node within LED driver 14. Current source I0 and diodes D3 and D4 deliver a substantially constant (e.g., DC) voltage at the ZCVS node, and the voltage that capacitor C4 couples to the ZCVS node causes the voltage at the ZCVS node to drop relative to the substantially constant voltage outputted by current source I0 and diodes D3 and D4. Valley detection circuit 18 receives the voltage at the ZCVS node (which is the combination of the coupled voltage and the substantially constant voltage) and determines that the drop in voltage relative to the substantially voltage outputted by current source I0 and diodes D3 and D4 is sufficient to indicate that voltage oscillations at the HV node are beginning, and in response, causes controller 16 to turn transistor M1 back on, which in turn causes transistor M0 to turn back on, and for the ILED current to rise back quickly as illustrated in FIG. 4A.

Accordingly, FIG. 4B illustrates one example manner in which to save switching power by turning transistors M1 and M0 back on when oscillation at the drain node of transistor M0 is detected (e.g., when a valley point is detected). In accordance with the techniques described in this disclosure, it may be possible to determine when the valley point is reached in the oscillation at the drain node of transistor M0 utilizing only the single input multi-function pin (DRAIN pin) of LED driver 14 and no other pin of LED driver 14 that is connected directly or indirectly via external circuitry to LEDs 0 and 1. For example, by coupling the voltage at the drain node of external transistor M0 to the signal input multi-function pin of LED driver 14, and delivering the substantially constant voltage inside LED driver 14, across which the coupled voltage can swing, it may be possible to detect the occurrence of the oscillation on the drain node of external transistor M0 utilizing a single pin of LED driver 14.

FIG. 4C illustrates the voltage at the DRAIN pin of LED driver 14. As illustrated, the voltage at the DRAIN pin of LED driver 14 generally tracks the voltage at the HV node (the drain node of transistor M0). Although not illustrated in FIG. 4C, in some examples, there may be a small ripple in the voltage at the switch off time on the DRAIN pin. The cause of small ripple may be due to the coupling of the voltage from the HV node to the DRAIN pin. For example, the small drop in the voltage illustrated in the dashed oval in FIG. 4B may appear as a small ripple in the voltage at the DRAIN pin because of the AC coupling of the voltage by capacitor C2.

In addition to illustrating the manner in which valley detection circuit 18 determines whether an oscillation at the drain node of transistor M0 is beginning to occur, FIGS. 4B and 4C also illustrate the manner in which the power supply (capacitor CVCC) is recharged during normal operation. As described above, during the startup mode when LED driver system 10 is connected to the AC input, capacitor CVCC, which functions as the power supply for LED driver 14, is charged through the current that flows through transistor M0. After capacitor CVCC charges to a certain level so that the voltage is at a proper level, LED driver 14 operates in the normal operation mode. In the normal operation mode, the charge on capacitor CVCC discharges, and capacitor CVCC needs to be recharged to provide the appropriate voltage level.

As illustrated in FIG. 4B, the voltage at the drain node of transistor M0 rises during the switch off time and falls during the switch on time. Capacitor C2 couples this change in the voltage at the drain node of transistor M0 to the DRAIN pin of LED driver 14, as illustrated by FIG. 4C. In accordance with the techniques described in this disclosure, in the normal operation mode, the coupled voltage at the DRIAN pin of LED driver 14 recharges capacitor CVCC so that the voltage at the VCC pin is at the appropriate voltage level for providing power to the components of LED driver 14.

As described above, the oscillation at the drain node of transistor M0 occurs shortly after the ILED current dissipates to zero. In other words, there is a delay from when the ILED current reaches zero amps to the occurrence of the first valley in the oscillation at the drain node of transistor M0.

Figure 5A:
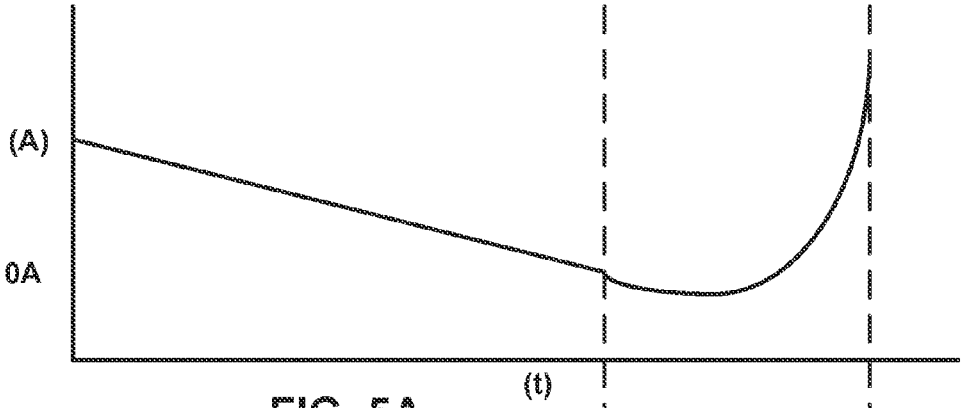
FIG. 5A is a waveform that illustrates the current through the one or more LEDs reaching an amplitude of zero.
Figure 5B:
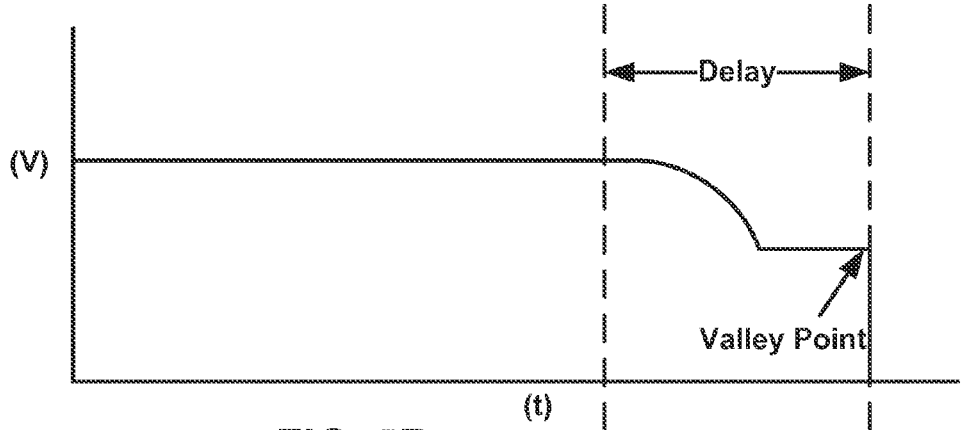
FIGS. 5B and 5C are waveforms that illustrate voltage levels at various nodes within the LED driver system such as a drain node of an external transistor and a drain node of an internal transistor, respectively, after the current through the one or more LEDs reached an amplitude of zero.
Figure 5C:
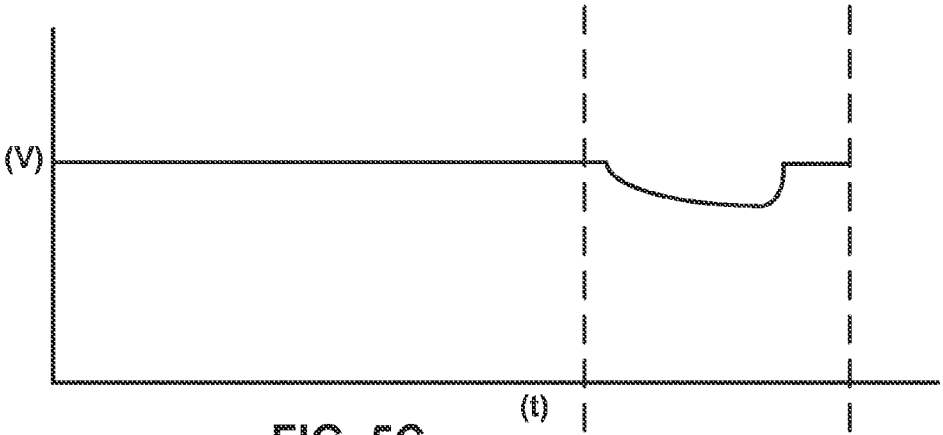

FIG. 5A is a waveform that illustrates the current through the one or more LEDs reaching an amplitude of zero. FIGS. 5B and 5C are waveforms that illustrate voltage levels at various nodes within the LED driver system after the current through the one or more LEDs reached an amplitude of zero. For instance, FIGS. 5A-5C illustrate the timing of when the ILED current reaches an amplitude of zero and when the first valley of the oscillation at the drain node of transistor M0 occurs.

FIG. 5A illustrates the ILED current dissipating during the current dissipation duration, and the point at which the ILED current reaches zero amps. FIG. 5B illustrates the voltage at the drain node of transistor M0 (HV node). As illustrated, there is a certain amount of time delay before the voltage at the drain node of transistor M0 reaches the first valley point. Again, the cause of the first valley is due to the oscillations that are beginning to occur at the drain node of transistor M0. FIG. 5C illustrates the voltage at the DRAIN pin of LED driver 14 (i.e., at the single input multi-function pin of LED driver 14).

In some examples, it may be beneficial to determine the time when the ILED current dissipated to zero, and prior to the occurrence of the first valley in the oscillation at the drain node of transistor M0. For example, it may be desirable to control the average current level of the ILED current. To determine the average current level of the ILED current, it may be desirable to determine the time when the amplitude of the ILED current reached zero amps.

The techniques described in this disclosure may utilize the same single input multi-function pin to determine the time when the ILED current reached zero amps. As illustrated in FIG. 1, zero current detection circuit 20 of controller 16 receives the voltage at the ZCVS node within LED driver 14 as an input. Zero current detection circuit 20 may utilize the voltage at the ZCVS node within LED driver 14 to determine an approximation of when the amplitude of the ILED current reached zero.

Figure 6:
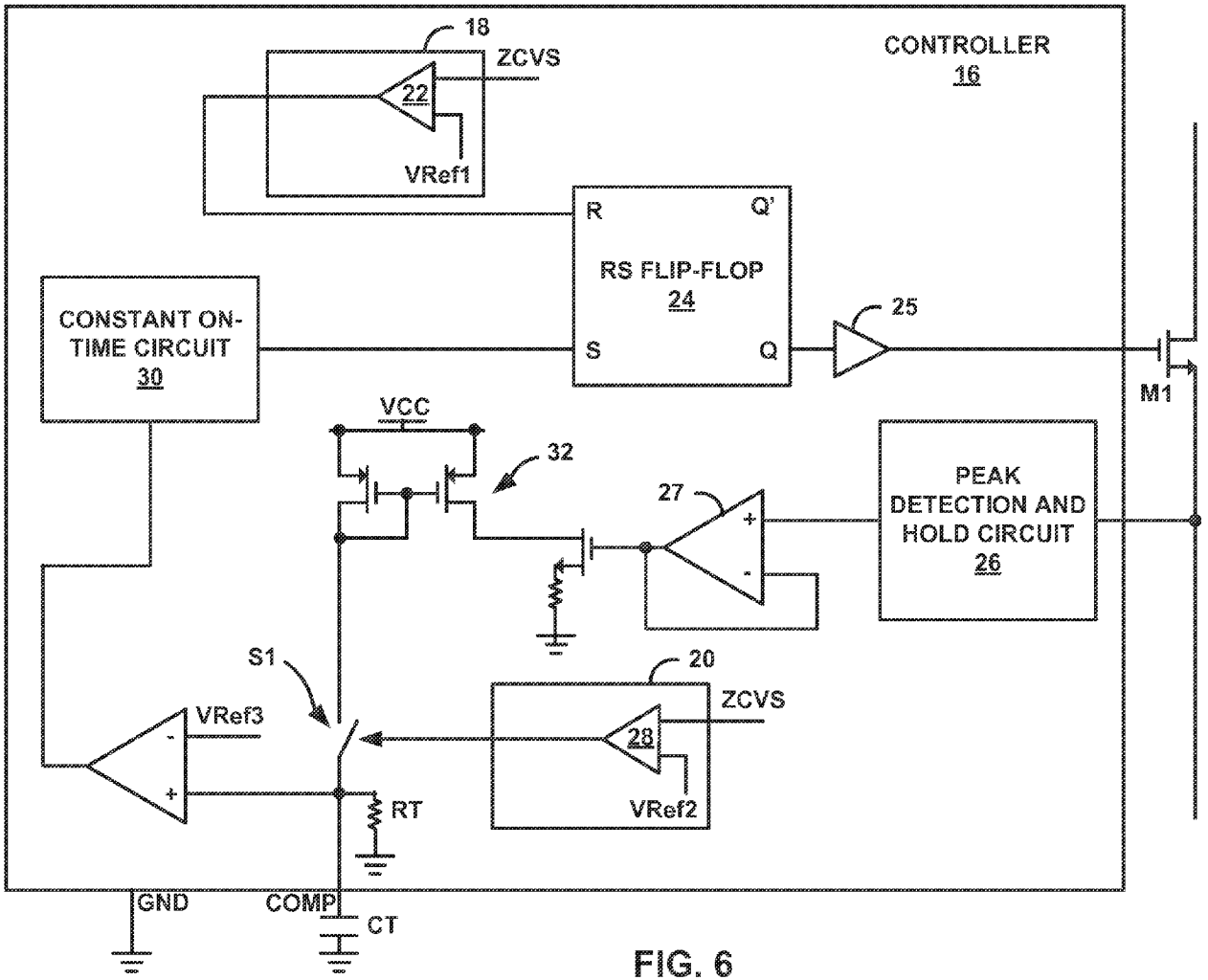
FIG. 6 is a circuit diagram illustrating a controller of the LED driver of FIG. 1 in greater detail.

FIG. 6 is a circuit diagram illustrating a controller of the LED driver of FIG. 1 in greater detail. As illustrated, controller 16 includes valley detection circuit 18 that includes comparator 22, and zero current detection circuit 20 that includes comparator 28. As also illustrated, valley detection circuit 18 and zero current detection circuit 20 each receive the voltage at the ZCVS node within LED driver 14 as an input.

Comparator 22 of valley detection circuit 18 may compare the voltage at the ZCVS node to a reference voltage (VRef1). If the voltage at the ZCVS node is less than that of the VRef1 voltage, valley detection circuit 18 may determine that the voltage at the drain node of transistor M0 (HV node) is beginning to oscillate. In response, comparator 22 may output a voltage to the reset (R) node of RS flip-flop 24 indicating that the voltage at the drain node of transistor M0 is beginning to oscillate. In turn, RS flip-flop 24 outputs a voltage on the Q node of RS flip-flop 24 that causes transistor M1 to turn on. As described above, transistor M1 turning on causes transistor M0 to turn on, which then cause the ILED current to flow through transistors M0 and M1 to squelch the oscillation at the drain node of transistor M0.

In some examples, RS flip-flop 24 may be coupled to buffer 25. Buffer 25 may convert the voltage received from the Q node to the appropriate level needed to drive the gate node of transistor M1. Buffer 25 may not be necessary in every example, and may be incorporated as part of RS flip-flop 24.

Comparator 28 of zero current detection circuit 20 may compare the voltage at the ZCVS node to a reference voltage (VRef2). If the voltage at the ZCVS node is less than that of the VRef2 voltage, zero current detection circuit 20 may determine that amplitude of the ILED current is zero amps. In response, comparator 28 may output a voltage that causes switch S1 to turn on, which results in a current flowing through resistor RT and charging the capacitor CT at the COMP pin of LED driver 14.

The voltage at the COMP pin of LED driver 14, which corresponds to the voltage across of capacitor CT, may be indicative of the average amount of current flowing through LEDs 0 and 1 (i.e., the average current level of the ILED current). For example, as illustrated, peak detection and hold circuit 26 receives the voltage at the source node of transistor M1. Peak detection and hold circuit 26 may be configured to detect the peak voltage at the source node of transistor M1, and hold that voltage level.

As illustrated, peak detection and hold circuit 26 outputs the voltage level to operational amplifier (op-amp) 27. Op-amp 27 converts the hold voltage level, outputted by peak detection and hold circuit 26, to a current. The current that op-amp 27 outputs is indicative of the amount of current that charges capacitor CT.

For example, op-amp 27 outputs to the gate node of a transistor, and when this transistor is turned on, current sinks through current mirror 32 and through the transistor to ground. The sinking of current through the transistor to ground causes a current to flow through switch S1, when closed, and charges capacitor CT.

In some examples, after the ILED current reaches an amplitude of zero amps, as determined by zero current detection circuit 20, there may be delay before controller 16 causes transistor M1 to turn on, which in turn causes transistor M0 to turn on. During this delay, zero current detection circuit 20 may cause switch S1 to be open, and no current is used to charge capacitor CT. During other times, such as when the amplitude of the ILED current is not at zero amps, zero current detection circuit 20 may cause switch S1 to be closed, and allow capacitor CT to charge. In this way, voltage across capacitor CT may be representative of the average amount of current flowing through LEDs 0 and 1.

As illustrated, another comparator may compare the voltage across capacitor CT to a reference voltage (VRef3). In some examples, the comparator may compare the voltage across capacitor CT with VRef3 over one AC half cycle of the AC input. The comparator may output the result of the comparison to constant on-time circuit 30. Constant on-time circuit 30, in turn, may output a voltage to the set (S) node of RS flip-flop 24 that indicates whether transistor M1 should be on or off.

In the techniques described in this disclosure, if the voltage across capacitor CT is higher than VRef3, then for the next AC half cycle, constant on-time circuit 30 may set the voltage at the S node of RS flip-flop 24 such that transistor M1 and transistor M0 are on for a shorter period of time, than the amount of time transistor M1 and transistor M0 were on for the previous AC half cycle. If the voltage across capacitor CT is lower than VRef3, then for the next AC half cycle, constant on-time circuit 30 may set the voltage at the S node of RS flip-flop 24 such that transistor M1 and transistor M0 are on for a longer period of time, than the amount of time transistor M1 and transistor M0 were on for the previous AC half cycle.

In other words, constant on-time circuit 30 sets the amount of time that transistor M1 and transistor M0 will be on for half a cycle of the AC input voltage. For the next half cycle of the AC input voltage, constant on-time circuit 30 may increase the amount of time transistor M1 and transistor M0 stay on or decrease the amount of time transistor M1 and transistor M0 stay on. By controlling the amount of time transistor M1 and M0 stay on, LED driver 14, via controller 16, may be able to control the average amount of the ILED current. For instance, the voltage across capacitor CT represents the average amount of the ILED current, and constant on-time circuit 30 controls the average amount of the ILED current by modifying the amount of time transistor M1 and M0 stay on, on a per half cycle basis, as one example. Constant on-time circuit 30 may control the amount of time transistors M1 and M0 stay on more or less than a per half cycle basis.

Accordingly, zero current detection circuit 20 may allow constant on-time circuit 30 to accurately control the average current flowing through LEDs 0 and 1. For example, by controlling switch S1 to be closed or opened, allows the voltage across capacitor CT to provide an accurate measure of the average current flowing through LEDs 0 and 1. In this manner, zero current detection circuit 20 may ensure that by controlling switch 51, constant on-time circuit 30 may be able to accurately control the average current flowing through LEDs 0 and 1 (i.e., the result of the comparison of the voltage across capacitor CT and VRef3 is an accurate estimation of the ILED current).

In this way, constant on-time circuit 30 may determine how long to keep transistors M0 and M1 on to keep the average current flowing through LEDs 0 and 1 to the desired level. Valley detection circuit 18 may determine when to turn transistors M0 and M1 back on (i.e., upon detection of a valley point). For example, when transistors M0 and M1 are turned on, the ILED current ramps up from zero amps. When transistors M0 and M1 are turned off, the ILED current dissipates down to zero amps. In floating buck topology illustrated in FIG. 1, capacitor C1 may provide the charge necessary for the ILED current to flow through LEDs 0 and 1, if the current through transistors M0 and M1 is low or the current flowing through diode D0 is low.

In accordance with the techniques described in this disclosure, the VRef1 voltage and the VRef2 voltage may be different. In some examples, the VRef1 voltage may be less than the VRef2 voltage. As illustrated in FIGS. 5B and 5C, the voltage at the HV node and at the DRAIN pin drops shortly after the amplitude of the ILED current reaches zero amps. By setting the voltage level of VRef2 greater than that of VRef1, when the voltage at the ZCVS node drops below the VRef2 voltage level, LED driver 14, via zero current detection circuit 20, may determine that the ILED current has already reached zero amps. Then, as the voltage at the ZCVS node keeps dropping and drops below the VRef1 voltage level, LED driver 14, via valley detection circuit 18, may determine that the voltage at the drain node of transistor M0 is beginning to oscillate.

It should be understood that utilizing comparators for the valley detection and the zero current detection is described for purposes of illustration only. For example, valley detection circuit 18 and zero current detection circuit 20 need not necessarily utilize comparators 22 and 28, respectively, for determining when the voltage at the drain node of transistor M0 is beginning to oscillate and for determining that the amplitude of the ILED current has reached zero amps. Other techniques that rely on the voltage at the ZCVS node for determining when the voltage at the drain node of transistor M0 is beginning to oscillate and for determining when the amplitude of the ILED current has reached zero amps may be possible.

Figure 7A:
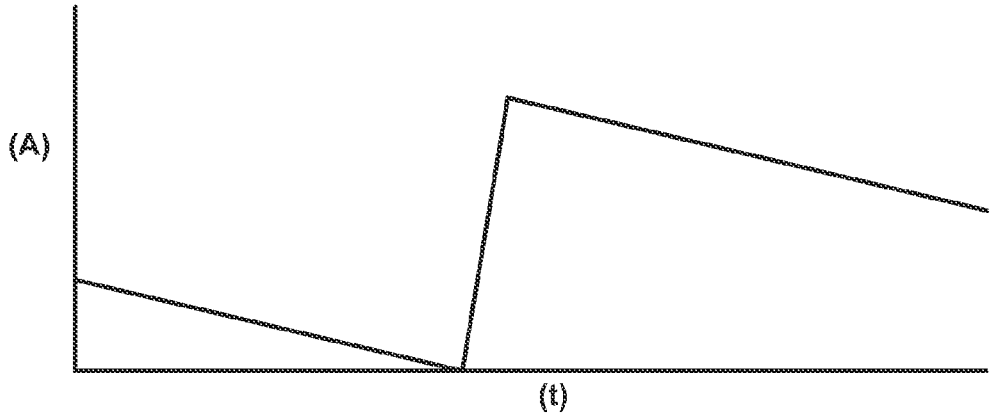
FIG. 7A is a waveform that illustrates the current through the one or more LEDs used to illustrate the manner in which valley detection and zero current detection may be implemented.
Figure 7B:
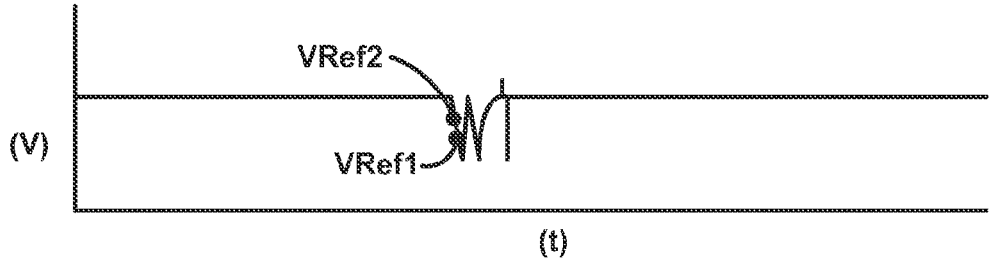
FIGS. 7B-7D are waveforms that illustrate voltages at various nodes within the LED driver system such as an internal node, a drain node of an external transistor, and a drain node of an internal transistor, respectively, to illustrate the manner in which valley detection and zero current detection may be implemented.
Figure 7C:
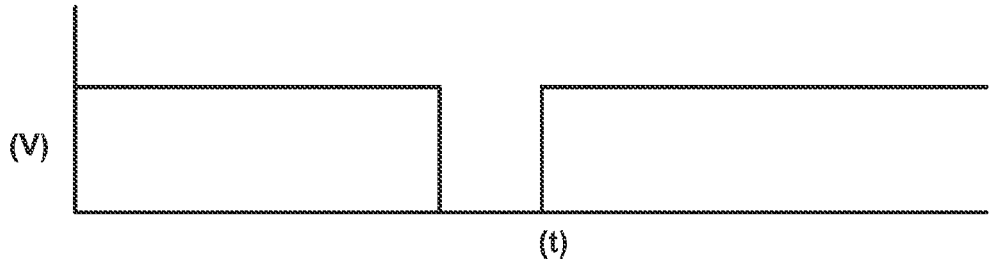
Figure 7D:
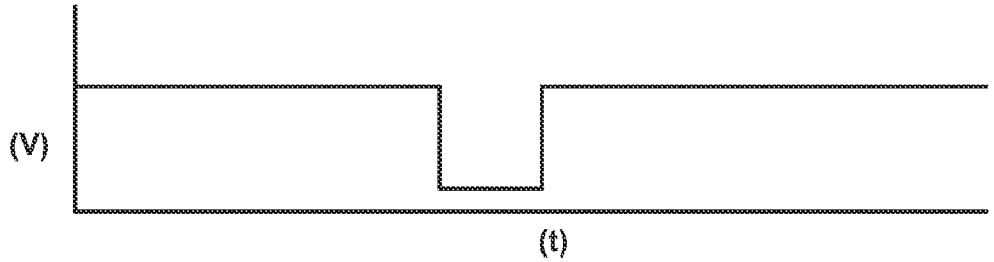

FIG. 7A is a waveform that illustrates the current through the one or more LEDs used to illustrate the manner in which valley detection and zero current detection may be implemented. FIGS. 7B-7D are waveforms that illustrate voltages at various nodes within the LED driver system to illustrate the manner in which valley detection and zero current detection may be implemented. For instance, FIG. 7A illustrates the ILED current dissipating during the current dissipation duration, followed by rising quickly, and then dissipating during the current dissipation duration.

FIG. 7B is a waveform that illustrates the voltage at the ZCVS node within LED driver 14 over the duration of the ILED current dissipating and rising. FIG. 7B also illustrates example voltage levels of VRef1 and VRef2. For example, the voltage level of VRef2 is illustrated as being greater than that of VRef1. In this example, as the voltage level of ZCVS drops below VRef2, after the amplitude of the ILED current drops to zero amps, zero current detection circuit 20, via comparator 28, may determine that the voltage at the ZCVS node is less than that of VRef2 and determine that the amplitude of the ILED current reached zero amps very recently. Also, as the voltage level of ZCVS further drops below VRef1, valley detection circuit 18, via comparator 22, may determine that the voltage at the ZCVS node is less than that of VRef1 and determine that the voltage at the drain node of transistor M0 is beginning to oscillate. FIGS. 7C and 7D illustrate the voltage at the drain node of transistor M0 and the DRAIN pin of LED driver 14, respectively.

In this manner, the techniques described in this disclosure provide for a closed-loop technique that relies on a single pin of LED driver 14 to implement the ILED current switching, charging of the power supply of LED driver 14 during startup and normal operation modes, determining of whether voltage oscillation on a drain node of external transistor M0 is beginning to occur, and determining whether the amplitude of the ILED current has reached zero after the current dissipation duration. The techniques may be referred to as closed-loop because when LED driver 14, via valley detection circuit 18, determines that the voltage at the drain node of transistor M0 is beginning to oscillate, LED driver 14 is configured to turn on transistor M0 (i.e., quasi_resonant operation). Also, the techniques may be referred to as closed-loop because when LED driver 14, via zero current detection circuit 20, determines that the amplitude of the ILED current has reached zero amps, constant on-time circuit 30 is capable of controlling the average amplitude of the ILED current.

Utilizing the DRAIN pin of LED driver 14 as a single input multi-function pin may allow LED driver 14 to require only five pins. For example, LED driver 14 may only require a DRAIN pin, which the techniques utilize to perform multiple different functions, a VCC pin which receives the power supply voltage from the capacitor CVCC, a VCS pin for where the ILED current exits LED driver 14, a COMP pin used for determining the average amount of the ILED current, and a ground (GND) pin, which provides a ground reference for the power pin (VCC).

The techniques described in this disclosure may provide benefits relative to some other proposed techniques. For instance, U.S. Pat. No. 8,253,350 B2 (referred to as the '350 patent herein) describes an LED driver, and illustrates the LED driver of the '350 patent in FIG. 4 of the '350 patent. While the techniques of the '350 patent utilize external and internal transistors for current switching, and utilize the external transistor for startup power, the '350 patent does not provide a mechanism by which to determine whether there are any oscillations on the drain node of the external transistor, does not provide a mechanism to automatically turn on the external transistor when oscillations being for power saving gains, much less utilizing the same pin through which the current through the one or more LEDs flow into the LED driver. Accordingly, the techniques of the '350 patent may not provide the efficiencies associated with turning the external transistor back on in response to the oscillations, as described in this disclosure.

Furthermore, the techniques described in the '350 patent may rely on pulse-width modulated signals to determine when the transistors turn on and off. In this case, the techniques described in the '350 patent may not provide a closed-loop mechanism to determine when the current through the one or more LEDs reaches an amplitude of zero amps, unlike the techniques described in this disclosure. Rather, the techniques described in the '350 patent rely on the timing of the pulse width modulation, which provides for an open-loop mechanism to determine when the current through the one or more LEDs reaches an amplitude of zero amps, which may not be as accurate as the closed-loop techniques described in this disclosure.

Also, the techniques described in the '350 patent may require multiple pins of the LED driver to connect to circuitry that is external to the LED driver and that connects to the one or more LEDs. Accordingly, the LED driver of the '350 patent may require more pins than the techniques described in this disclosure, which may result in more cost and more real estate on the circuit board that includes the LED driver.

Another proposed technique is described in datasheet for the SSL21081/SSL21083 LED driver by NXP. For instance, FIG. 3 in the datasheet for the SSL21081/SSL21083 LED driver illustrates the connection of an LED driver with other components for driving one or more LEDs. In this proposed technique, it may be possible to determine whether the voltage at the drain node of the external transistor is beginning to oscillate. However, in the techniques described in the datasheet by NXP, the LED driver requires multiple pins for power supply charging, and neither of the pins are the same pin through which the current through the one or more LEDs flows into the LED driver. For instance, the techniques described in the datasheet by NXP, require one pin through which the power supply is charged during startup, and another pin though which the power supply is charged during normal mode, where neither of these pins is the same pin through which the current through the one or more LEDs flows into the LED driver.

Figure 8:
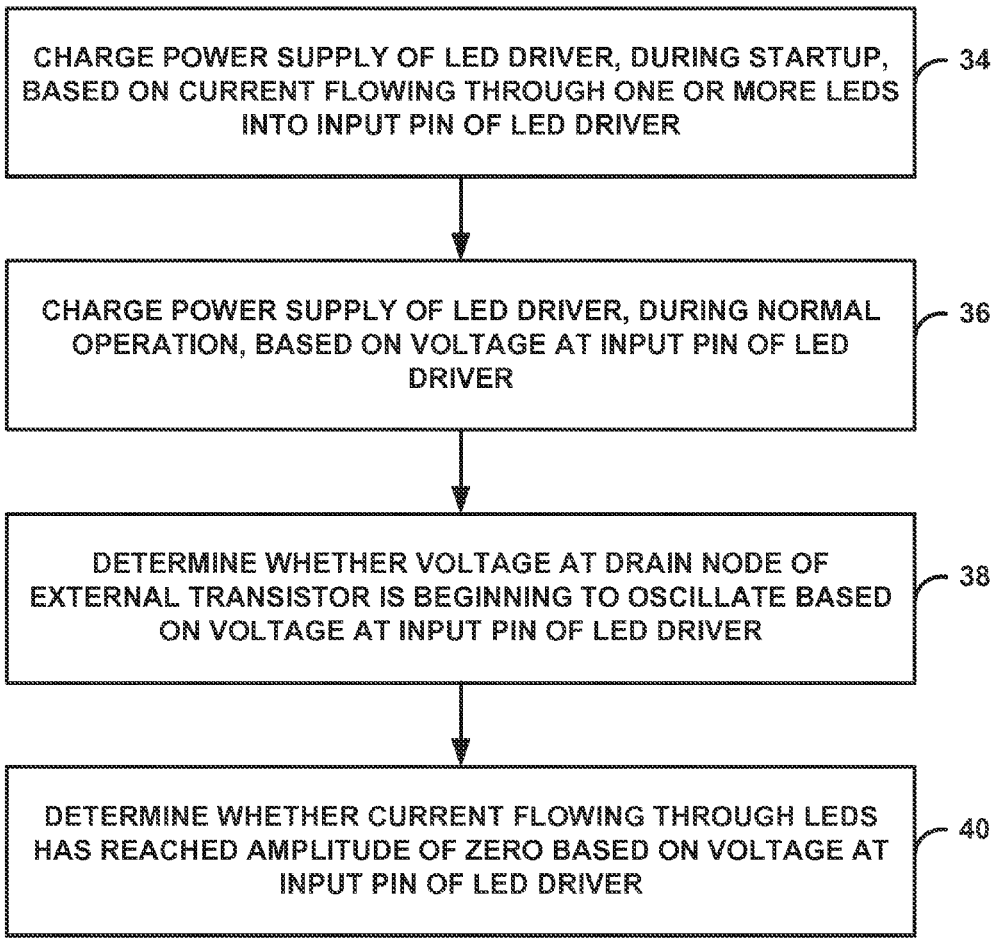
FIG. 8 is a flowchart illustrating an example technique in accordance with the techniques described in this disclosure.

FIG. 8 is a flowchart illustrating an example technique in accordance with the techniques described in this disclosure. As illustrated, the techniques may charge a power supply of an LED driver, during startup, based on current flowing through one or more LEDs into an input pin of the LED driver (34). For example, during startup, when LED driver system 10 is connected to a power source (e.g., an AC input or a DC input power source), transistor M0 turns on and the ILED current flows through transistor M0 and into LED driver 14 via the single input multi-function pin (DRAIN pin) of LED driver 14. This flow of current charges capacitor CVCC, which is the power supply of LED driver 14.

The techniques of this disclosure may charge the power supply of the LED driver, during normal operation, based on a voltage at the input pin of the LED driver (36). For example, during normal operation, capacitor CVCC may provide power to the components of LED driver 14 which causes capacitor CVCC to discharge. The techniques may utilize the voltage at the DRAIN pin of LED driver 14 to recharge capacitor CVCC. For instance, during normal operation, the voltage at the drain node of transistor M0 changes. Capacitor C2 couples this change in the voltage to the DRAIN pin of LED driver 14, which in turn recharges capacitor CVCC.

The techniques of this disclosure may also determine whether voltage at an external node (e.g., the drain node of the external transistor M0 which is external to LED driver 14) is beginning to oscillate based on the voltage at the input pin of the LED driver (38). In addition, the techniques may determine whether the current flowing through the one or more LEDs has reached an amplitude of zero amps based on the voltage at the input pin of the LED driver (40). In some examples, the techniques may rely on the voltage only at the input pin of the LED driver to determine whether the voltage at the external node is beginning to oscillate and determine whether the current flowing through the one or more LEDs has reached the amplitude of zero amps.

For example, LED driver 14 includes capacitor C4, and capacitor C4 may couple the voltage at the input pin (DRAIN pin) to an internal node of LED driver 14. In this disclosure, this internal node of LED driver 14 is referred to as the ZCVS node. Controller 16 may determine whether the voltage at the drain node of transistor M0 is beginning to oscillate and determine whether the current flowing through the one or more LEDs has reached the amplitude of zero based on the coupled voltage at the internal node (ZCVS node).

However, in some cases, it may be desirable to deliver a substantially stable voltage at the internal node because, otherwise, the coupled voltage at the internal node may be floating. In some examples, LED driver 14 includes circuitry that provides the substantially stable (e.g., DC) voltage at the internal node. In these examples, controller 16 may determine whether the voltage at the drain node of transistor M0 is beginning to oscillate and determine whether the current flowing through the one or more LEDs has reached the amplitude of zero based on the voltage at the internal node (e.g., ZCVS node) which is a combination of the coupled voltage and the substantially constant voltage. In some examples, the circuitry that provides the substantially constant voltage at the internal node may include current source I0 and one or mode diodes D3 and D4. The current outputted by current source I0 provides a stable DC voltage and the one or more diodes D3 and D4 set the voltage level of the substantially constant voltage.

To determine whether the voltage at the drain node of transistor M0 is beginning to oscillate, valley detection circuit 18 of controller 16 may include comparator 22. Comparator 22 may compare the voltage at the internal node (ZCVS node) to a reference voltage (VRef1), and valley detection circuit 18 may determine whether the voltage at the drain node of transistor M0 is beginning to oscillate based on the comparison. Similarly, to determine whether the current flowing through the one or more LEDs has reached an amplitude of zero, zero current detection circuit 20 of controller 16 may include comparator 28. Comparator 28 may compare the voltage at the internal node (ZCVS node) to a reference voltage (VRef2), and zero current detection circuit 20 may determine whether the current flowing through the one or more LEDs (the ILED current) has reached an amplitude of zero based on the comparison.

In some examples, the voltage level of VRef2 may be greater than the voltage level of VRef1 because the ILED current reaches the amplitude of zero shortly before the voltage at the drain node of transistor M0 begins to oscillate. Therefore, zero current detection circuit 20 may determine that the current flowing through the one or more LEDs has reached an amplitude to zero shortly before valley detection circuit 18 determines that the voltage at the drain node of transistor M0 is beginning to oscillate.

Figure 9:
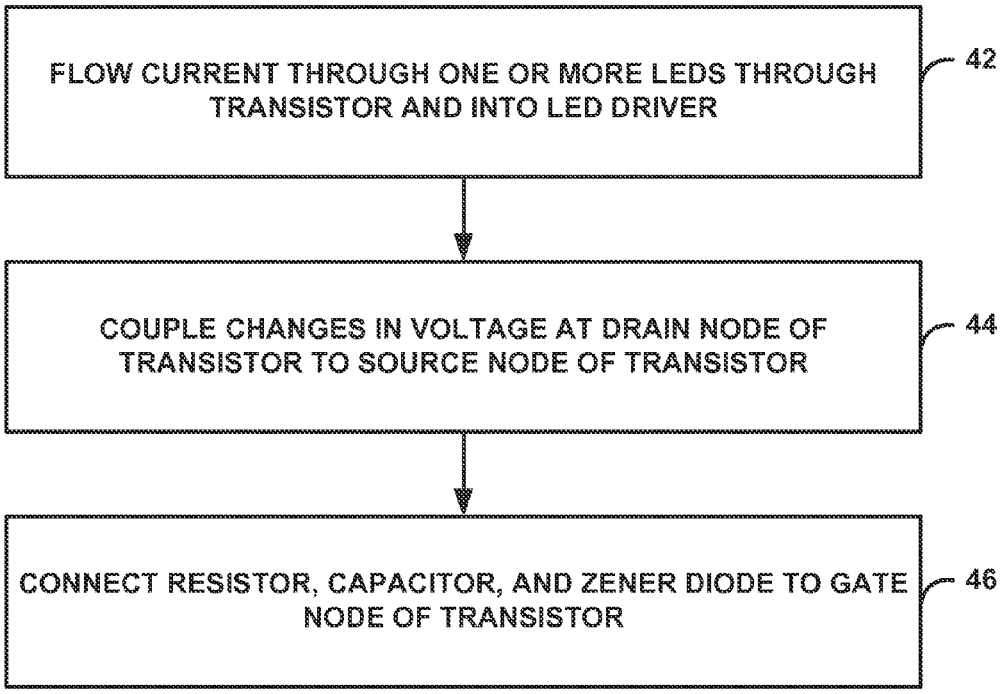
FIG. 9 is a flowchart illustrating another example technique in accordance with the techniques described in this disclosure.

FIG. 9 is a flowchart illustrating another example technique in accordance with the techniques described in this disclosure. As illustrated, the techniques may cause current to flow through one or more LEDs through a transistor and into an LED driver (42). For example, when transistor M0 is turned on, the ILED current flows through LEDs 0 and 1 through transistor M0 and into LED driver 14 at the single input multi-function pin (DRAIN pin) of LED driver 14.

The techniques may couple changes in voltage at the drain node of the transistor to the source node of the transistor (44). For example, capacitor C2 may couple the changes in the voltage at the drain node of transistor M0 to the source node of transistor M0. Such coupling of the voltage by capacitor C2 may provide at least two functions. The first function may be to charge the power supply (e.g., capacitor CVCC) of LED driver 14 during normal operation mode. The second function may be to couple the changes in the voltage at the drain node of transistor M0 caused by the voltage at the drain node of transistor M0 beginning to oscillate.

The techniques may connect a resistor, capacitor, and zener diode to the gate node of the transistor (46). For example, resistor R0, capacitor C3, and zener diode are all connected to the gate node of transistor M0. Resistor R0 is further connected to the power source of LED driver system 10.

During startup, resistor R0 may gradually charge capacitor C3 until the voltage across capacitor C3 becomes large enough to turn on transistor M0. With transistor M0 turned on, current flows through transistor M0 and causes the capacitor CVCC to charge. During startup, transistor M1 may be off. Zener diode Z0 may clamp the voltage across capacitor C3 to limit the voltage across capacitor C3. As one example, zener diode Z0 may limit the voltage across capacitor C3 to be no greater than 12V.

As described above, LEDs 0 and 1, capacitor C1, inductor L0, and diode D0 together form a floating buck topology. However, the techniques described in this disclosure are not limited to the floating buck topology. For instance, the techniques described in this disclosure may be extended to examples where LEDs 0 and 1 are formed as part of a tapped buck topology and a quasi-flyback topology.

Figure 10:
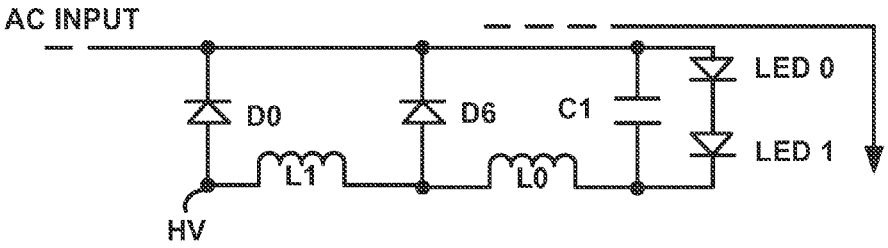
FIG. 10 is a circuit diagram illustrating a tapped buck topology in accordance with one or more examples described in this disclosure.

FIG. 10 is a circuit diagram illustrating a tapped buck topology in accordance with one or more examples described in this disclosure. The tapped buck topology of FIG. 10 may be similar to the floating buck topology of FIG. 1. However, the tapped buck topology includes an additional inductor L1 and a diode D6. Inductors L0 and L1 may be connected to one another, and diode D6 may connect inductors L0 and L1 to the AC input line.

Figure 11A:
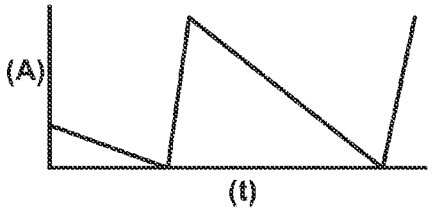
FIGS. 11A and 11B are waveforms that illustrate the current flowing through a floating buck topology and a tapped buck topology, respectively.
Figure 11B:
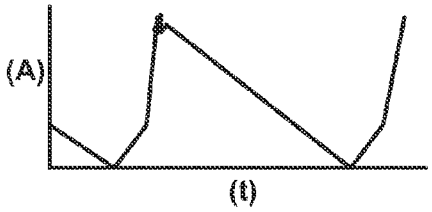

FIGS. 11A and 11B are waveforms that illustrate the current flowing through a floating buck topology and a tapped buck topology, respectively. FIGS. 11A and 11B illustrate that the difference between the ILED current in the floating buck topology and the tapped buck topology. For instance, as illustrated in FIG. 11B, when the ILED current flows through transistor M0 and M1, the current rises and there is a slight ringing before the switch of time for the tapped buck topology, relative to ILED current of the floating buck topology illustrated in FIG. 11A. Also, as illustrated in FIG. 11B, when the ILED current flows through transistors M0 and M1, the current rises to one level, and then jumps quickly to a higher level for the tapped buck topology, relative to the ILED current of the floating buck topology illustrated in FIG. 11A.

Figure 12:
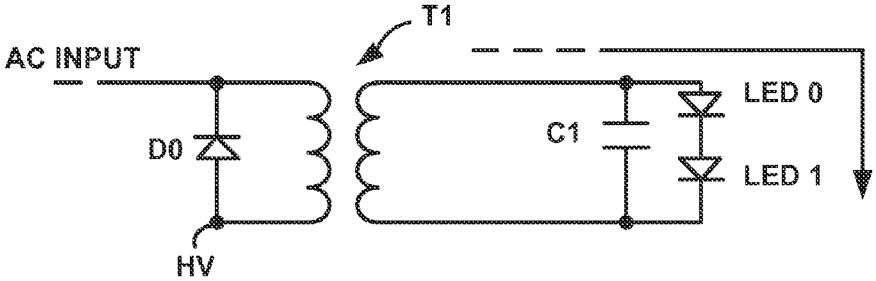
FIG. 12 is a circuit diagram illustrating a quasi-flyback topology in accordance with one or more examples described in this disclosure.

FIG. 12 is a circuit diagram illustrating a quasi-flyback topology in accordance with one or more examples described in this disclosure. In the quasi-flyback topology, inductor L0 of the floating buck topology is replaced with a transform T1. For example, diode D0 is connected to a first side of transform T1, and capacitor C1 and LEDs 0 and 1 are connected to a second side of transform T1.

Figure 13A:
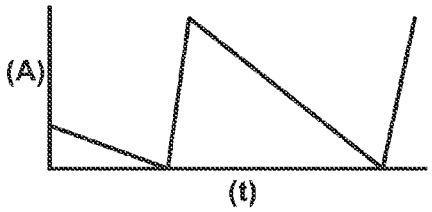
FIGS. 13A and 13B are waveforms that illustrate the current flowing through a floating buck topology and a quasi-flyback topology, respectively.
Figure 13B:
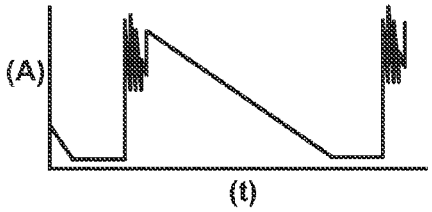

FIGS. 13A and 13B are waveforms that illustrate the current flowing through a floating buck topology and a quasi-flyback topology, respectively. As illustrated in FIG. 13B, the rise of the ILED current in the quasi-flyback topology is quicker than the rise of the ILED current in the floating buck topology illustrated in FIG. 13A. Also, after the ILED current in the quasi-flyback topology reaches its peak, there is some potential ringing before the current drops relative to the floating buck topology illustrated in FIG. 13A. Also, for the quasi-flyback topology the delay from when the current reaches the amplitude of zero to when the voltage at the drain node of transistor M0 beings to oscillate may be longer than the delay from when the current reaches the amplitude of zero to when the voltage at the drain node of transistor M0 begins to oscillate for the floating buck topology.

Various examples of techniques and circuits have been described. These and other examples are within the scope of the following claims.

The invention claimed is:

1. A light emitting diode (LED) driver comprising:

an input pin that receives a current flowing through one or more LEDs into the LED driver; and a controller configured to determine whether a voltage at an external node that is external to the LED driver is beginning to oscillate based on a voltage at the input pin that receives the current in the LED driver, and determine whether the current flowing through the one or more LEDs has reached an amplitude of zero based on the voltage at the same input pin.

2. The LED driver of claim 1, wherein the current flowing into the input pin charges a power supply of the LED driver during startup mode and the voltage at the input pin charges the power supply of the LED driver during normal operation mode.

3. The LED driver of claim 1, wherein the controller is configured to determine whether the voltage at the external node that is external to the LED driver is beginning to oscillate and determine whether the current flowing through the one or more LEDs has reached the amplitude of zero based on the voltage at the input pin and no other pin of the LED driver.

4. The LED driver of claim 1, further comprising:

a transistor that includes a drain node, a gate node, and a source node, wherein the drain node of the transistor is connected to the input pin, wherein a voltage at the gate node controls whether the current flowing through the one or more LEDs flows into the LED driver through the drain node and source node of the transistor.

5. The LED driver of claim 4, wherein the controller is configured to turn on the transistor if the controller determines that the voltage at the external node is beginning to oscillate by outputting the voltage to the gate node of the transistor that causes the current flowing through the one or more LEDs to flow through the transistor.

6. The LED driver of claim 1, further comprising:

an internal node; and a capacitor that couples a voltage at the input pin to the internal node, wherein the controller is configured to determine whether the voltage at the external node is beginning to oscillate based on the coupled voltage at the internal node.

7. The LED driver of claim 6, the LED driver further comprising:

circuitry that delivers a substantially constant voltage at the internal node, wherein the controller is configured to determine whether the voltage at the external node is beginning to oscillate based on the coupled voltage at the internal node and the substantially constant voltage at the internal node.

8. The LED driver of claim 7, wherein the circuitry comprises:

a current source connected to the internal node; and one or more diodes that connect to the current source and the internal node, wherein the current source and the one or more diodes deliver the substantially constant voltage at the internal node.

9. The LED driver of claim 7, wherein the controller is configured to determine whether the current flowing through the one or more LEDs has reached the amplitude of zero based on the coupled voltage at the internal node and the substantially constant voltage at the internal node.

10. The LED driver of claim 7, wherein the controller comprises a valley detection circuit, wherein the valley detection circuit is configured to:

compare the voltage at the internal node that includes the coupled voltage and the substantially constant voltage to a reference voltage; and determine whether the voltage at the external node is beginning to oscillate based on the comparison.

11. The LED driver of claim 7, wherein the controller comprises a zero current detection circuit, wherein the zero current detection circuit is configured to:

compare the voltage at the internal node that includes the coupled voltage and the substantially constant voltage to a reference voltage; and determine whether the current flowing through the one or more LEDs has reached an amplitude of zero based on the comparison.

12. A method comprising:

receiving, via an input pin of a lighting emitting diode (LED) driver, a current that flows through one or more LEDs into the LED driver;

determining whether a voltage at an external node that is external to the LED driver is beginning to oscillate based on a voltage at the input pin; and determining whether the current flowing through the one or more LEDs has reached an amplitude of zero based on the voltage at the same input pin.

13. The method of claim 12, further comprising:

charging a power supply of the LED driver, during startup, based on the current flowing through the one or more LEDs into the LED driver; and charging the power supply of the LED driver, during normal operation, based on the voltage at the input pin of the LED driver.

14. The method of claim 12, wherein determining whether the voltage at the external node is beginning to oscillate and determining whether the current flowing through the one or more LEDs has reached the amplitude of zero comprises determining whether the voltage at the external node is beginning to oscillate and determining whether the current flowing through the one or more LEDs has reached the amplitude of zero based on the voltage at the same input pin and no other pin of the LED driver.

15. The method of claim 12, further comprising:

coupling, with a capacitor, a voltage at the input pin to an internal node of the LED driver, wherein determining whether the voltage at the external node is beginning to oscillate comprises determining whether the voltage at the external node is beginning to oscillate based on the coupled voltage at the internal node.

16. The method of claim 15, further comprising:

delivering a substantially constant voltage at the internal node, wherein determining whether the voltage at the external node is beginning to oscillate comprises determining whether the voltage at the external node is beginning to oscillate based on the coupled voltage at the internal node and the substantially constant voltage at the internal node.

17. The method of claim 16, wherein determining whether the current flowing through the one or more LEDs has reached the amplitude of zero comprises determining whether the current flowing through the one or more LEDs has reached an amplitude of zero based on the coupled voltage at the internal node and the substantially constant voltage at the internal node.

18. A light emitting diode (LED) driver comprising:

an input pin that receives a current flowing through one or more LEDs into the LED driver;

means for determining whether a voltage at an external node that is external to the LED driver is beginning to oscillate based on a voltage at the input pin; and means for determining whether the current flowing through the one or more LEDs has reached an amplitude of zero based on the voltage at the same input pin.

19. The LED driver of claim 18, further comprising:

means for charging a power supply of the LED driver, during startup, based on a current flowing through one or more LEDs into the LED driver; and means for charging the power supply of the LED driver, during normal operation, based on the voltage at the input pin of the LED driver.

20. The LED driver of claim 18, further comprising:

means for coupling a voltage at the input pin to an internal node of the LED driver; and means for delivering a substantially constant voltage at the internal node, wherein the means for determining whether the voltage at the external node is beginning to oscillate comprises means for determining whether the voltage at the external node is beginning to oscillate based on the coupled voltage at the internal node and the substantially constant voltage at the internal node, and wherein the means for determining whether the current flowing through the one or more LEDs has reached an amplitude of zero comprises means for determining whether the voltage at the external node is beginning to oscillate based on the coupled voltage at the internal node and the substantially constant voltage at the internal node.

* * * * *